US011278821B2

(12) United States Patent
Brain

(10) Patent No.: US 11,278,821 B2
(45) Date of Patent: Mar. 22, 2022

(54) MODULAR TOY BLOCK SYSTEM

(71) Applicant: Jason R. Brain, Bainbridge Island, WA (US)

(72) Inventor: Jason R. Brain, Bainbridge Island, WA (US)

( * ) Notice: Subject to any disclaimer, the term of this patent is extended or adjusted under 35 U.S.C. 154(b) by 11 days.

(21) Appl. No.: 15/898,173

(22) Filed: Feb. 15, 2018

(65) Prior Publication Data

US 2018/0229145 A1 Aug. 16, 2018

Related U.S. Application Data

(60) Provisional application No. 62/459,826, filed on Feb. 16, 2017.

(51) Int. Cl.
*A63H 33/06* (2006.01)

(52) U.S. Cl.
CPC ..... *A63H 33/062* (2013.01)

(58) Field of Classification Search
CPC .... A63H 33/062; A63H 33/101; A63H 33/08; A63H 33/086; A63H 33/04; A63H 33/044; A63H 33/06; A63H 17/002
See application file for complete search history.

(56) References Cited

U.S. PATENT DOCUMENTS 316,764 A * 4/1885 Wgstcott ..... B23D 73/00 76/24.1
319,764 A * 6/1885 Westcott ..... A63H 33/084 52/591.1
654,532 A * 7/1900 Furness ..... E04B 2/12 52/575
1,182,980 A * 5/1916 Converse ..... A63H 33/062 446/121
1,281,856 A * 10/1918 Shaw ..... A63H 33/105 446/112
1,894,605 A * 1/1933 John ..... A63H 33/04 446/122
1,971,545 A * 8/1934 Tompkins ..... A63H 33/062 446/121

(Continued)

FOREIGN PATENT DOCUMENTS

DE 3821144 A1 * 12/1989 ..... B65D 81/361
DE 202006014679 U1 * 12/2006 ..... F16B 12/46

(Continued)

*Primary Examiner* — Melba Bumgarner
*Assistant Examiner* — Amir A Klayman
(74) *Attorney, Agent, or Firm* — Seed Intellectual Property Law Group LLP

(57) ABSTRACT

A modular block toy and kit that includes a male cubic unit piece having a plurality of faces with a male node extending from each respective face of the plurality of faces, and a female piece having a plurality of faces and corners formed by three intersecting faces, the female piece having a female component formed on a respective face of each of the plurality of faces that is sized and shaped to receive a respective male node enabling connection using any side of the female piece and any side of the male piece, and in which all sides of the female pieces and the male cubic unit pieces with a snapping and interlock design are identical, enabling the pieces to be snapped together using any side of the female or male piece to achieve build out indefinitely in any direction.

13 Claims, 16 Drawing Sheets

Two-Variant System Cross Channel

(56) References Cited

U.S. PATENT DOCUMENTS 2,472,363 A * 6/1949 Blackinton ..... A63H 33/082 446/127
3,545,123 A * 12/1970 Muller ..... E04B 1/5831 446/116
3,611,620 A * 10/1971 Perry ..... A63H 33/108 446/121
3,640,018 A * 2/1972 Light ..... B65D 81/361 446/77
3,657,838 A * 4/1972 Hanning ..... A63H 33/08 446/126
3,728,800 A * 4/1973 Magram ..... G09B 1/36 434/171
3,747,261 A * 7/1973 Salem ..... A63H 33/108 446/104
3,973,855 A * 8/1976 Florence ..... A63H 33/105 403/171
4,033,947 A * 7/1977 Vogt ..... C07D 487/04 540/499
4,317,306 A * 3/1982 Hotti ..... A63H 33/105 446/126
D266,748 S * 11/1982 Vandoni ..... D11/61
4,428,581 A * 1/1984 Nagorny ..... G09B 1/34 273/153 S
4,493,425 A * 1/1985 Yoshida ..... A47B 47/0033 206/504
D283,635 S * 4/1986 Kato ..... D21/499
4,676,762 A * 6/1987 Ballard ..... A63H 33/105 446/104
D296,342 S * 6/1988 Knudsen ..... D21/499
4,872,682 A * 10/1989 Kuchimanchi ..... A63F 9/083 273/153 S
4,901,672 A * 2/1990 Rosenberger ..... A01K 1/03 119/498
5,000,713 A * 3/1991 Cheng ..... A63H 33/06 273/160
5,120,253 A * 6/1992 Gelardi ..... A63H 33/10 446/109
5,122,015 A * 6/1992 Shen ..... E02B 3/14 405/284
5,282,767 A * 2/1994 Gelardi ..... A63H 33/06 446/107
D359,315 S * 6/1995 Tacey ..... D21/499
5,458,522 A * 10/1995 Brooks, III ..... A63H 33/048 446/85
5,562,519 A * 10/1996 Loewenton ..... A63H 33/08 446/105
5,575,120 A * 11/1996 Handley ..... A47B 87/007 446/124
5,647,185 A * 7/1997 Forlini ..... E04B 2/06 405/284
D384,986 S * 10/1997 Schmidt ..... D21/503
5,685,120 A * 11/1997 Sihra ..... A63H 33/06 273/156
5,799,943 A * 9/1998 Morgan ..... A63F 3/0423 273/160
5,928,052 A * 7/1999 Buscher ..... A63H 33/10 446/118
6,250,986 B1 * 6/2001 Sorensen ..... A63H 33/062 446/121
6,322,414 B1 * 11/2001 Lin ..... A63H 33/10 446/122
6,386,542 B1 * 5/2002 Lore ..... A63F 9/12 273/156
6,679,780 B1 * 1/2004 Shih ..... A63F 9/1204 273/156
6,725,128 B2 * 4/2004 Hogg ..... G06N 3/008 318/560
D506,790 S * 6/2005 Gee ..... D21/479
7,198,270 B1 * 4/2007 Bishop ..... A63F 9/12 273/153 S
7,527,845 B2 * 5/2009 King ..... A41D 31/0005 190/124
8,266,855 B1 * 9/2012 Altararwah ..... E04B 2/08 52/275
8,715,029 B2 * 5/2014 Bishop ..... A63H 33/084 446/108
D725,716 S * 3/2015 Kaplan ..... D21/484
9,238,179 B2 * 1/2016 Carpenter ..... A63H 33/062
9,333,438 B2 * 5/2016 Lee ..... A63H 33/086
9,437,954 B2 * 9/2016 Marshall ..... H01R 13/514
9,808,734 B2 * 11/2017 Kuo ..... A63H 33/082
9,829,022 B2 * 11/2017 Su ..... F16B 7/0413
10,646,791 B2 * 5/2020 Semling ..... A63H 33/088
11,123,652 B2 * 9/2021 Haldeman ..... A63H 33/084
2005/0230910 A1 * 10/2005 Urriza ..... A63F 9/12 273/160
2007/0178800 A1 * 8/2007 Kim ..... A63H 33/084 446/124

FOREIGN PATENT DOCUMENTS

JP 2004275681 A * 10/2004
KR 20030065059 A * 8/2003 ..... A63H 33/046
WO WO-2018001018 A1 * 1/2018 ..... A63H 33/08

* cited by examiner

Cubic Base Unit

Two-Variant System Cross Channel

Two-Variant System Tee Channel

Two-Variant System Single Channel

MODULAR TOY BLOCK SYSTEM

BACKGROUND

Technical Field

The present disclosure pertains to toys and, more particularly, to the design, building, and sharing of a modular toy block system employing a universal snapping modular block system.

Description of the Related Art

Various modular block toys exist such as the LEGO® brick owned by the LEGO Group, Nanoblocks®, Snap Cubes®, and Click-A-Brick®, not to mention an international plethora of LEGO brick knock-offs Existing block systems that employ snapping cubes specifically do not snap on all faces unit-to-unit contiguously, which results in a faulty amalgamated model that is weakly bound together physically. Pins, rods, and other connectors are also employed in existing cubic modular toys. A non-contiguous snapping system is a problem if the user wants to create something that is sturdy and does not fall apart (especially for larger creations) and that is easily expanded in all directions in a consistent design and structurally sound manner. On the other side of the market, LEGO bricks and Nanoblock blocks do not operate out of a contiguous cubic system and instead snap top-to-bottom, with unique pieces such as "plates" to facilitate lateral expansion of a model. Similarly, other brands rely on pins, rods, clips or other snapping components to lock.

BRIEF SUMMARY

The present disclosure is directed to a modular toy that utilizes physical snapping and locking modular block toys.

In accordance with one aspect of the present disclosure, a modular block toy is provided that includes a male cubic unit piece having a plurality of faces with a male node extending from each respective face of the plurality of faces, and a female cubic unit piece having a plurality of faces and corners formed by three intersecting faces, the female piece having a female component formed on a respective face of each of the plurality of faces that is sized and shaped to receive a respective male node from the male cubic unit piece with an interference fit, thereby enabling the female piece and the male piece to be connected together using any side of the female piece and any side of the male piece.

In accordance with another aspect of the present disclosure, all of the male nodes are of the same size and shape.

In accordance with yet a further aspect of the present disclosure, the male cubic unit piece has the male node centered on each respective face of the male piece, and wherein the female piece has a protuberance formed on each corner to extend onto each face adjacent to the respective corner to define the female component as a cross-shaped channel.

In accordance with still yet another aspect of the present disclosure, the male cubic unit piece has the male node centered on the respective face, and wherein the female piece has a protuberance formed on each corner to extend onto each face adjacent to the respective corner to define the female component as a T-shaped channel.

In accordance with another aspect of the present disclosure, the male cubic unit piece has the male node centered on the respective face, and wherein the female piece has a protuberance formed on each corner to extend onto each face adjacent to the respective corner to define the female component as at least one channel on each face of the female piece.

In accordance with a further aspect of the present disclosure, the male cubic unit piece and the female piece are sized to be manipulated by the human hand such that a male piece can be held in one hand and a female piece held in the other hand, and through manipulation of the two hands, the two pieces can be connected together, or the female component has one of a snapping bump, ramp, and groove that creates an interlock between a respective mating male node and female component when connected together in a flush face-to-face manner, or the male node and the female component each have one of a snapping bump, ramp and groove that creates an interlock between a respective mating male node and female component when connected together in a flush face-to-face manner, or any combination of the foregoing.

In accordance with another implementation of the present disclosure, a modular block system is provided that includes a first block having a plurality of faces and a projection extending from each face, and a second block having an interior block with a plurality of faces that form a plurality of corners, the second block having a plurality of protuberances that define at least one channel on a respective face, each channel sized and shaped to receive a projection from the first block with an interference fit that allows for connecting the second block to any one of the faces on the first block.

In accordance with another aspect of the present disclosure, a kit is provided that includes a plurality of first blocks, each first block having a plurality of faces and a projection extending from each face, and a plurality of second blocks, each second block having an interior block with a plurality of faces that form a plurality of corners, the second block having a plurality of protuberances that define at least one channel on a respective face, each channel sized and shaped to receive a projection from the first block with an interference fit that allows for connecting the second block to any one of the faces on the first block.

In accordance with another aspect of the present disclosure, the first blocks have the first projection centered on the respective face, and the second blocks have a protuberance formed on each corner to extend onto each face adjacent to the respective corner and connect with two adjacent protuberances to define a single channel on each face of the second blocks, thereby enabling the first blocks and the second blocks to be connected together using any side of the first blocks and the second blocks, and further enabling additional contiguous connection of additional first and second blocks indefinitely in any direction.

In one aspect of the present disclosure, a universal modular block system is provided that enables the design and construction of physical block models with the system units (also known as pieces or cubic units). The core system building block is the cubic unit as illustrated in FIG. 1. There are two variants of the core system cubic unit. One is a cubic unit with a male connector on all sides, and the other is a cubic unit with a female connector on all sides. The design of the male unit is constant (although the exact design of the male node and the interference fit design aspects of the male node can be modified if desired). For example, the male node could be designed with beveled corners to enable a desired snapping action. The design of the female unit is in three design modes. The first mode is referred to herein as the "cross-channel" mode illustrated in FIG. 2. The second mode is referred to herein as the "T-channel" mode as shown in FIG. 3. The third mode is referred to herein as the "single-channel" mode as shown in FIG. 4.

The single-channel mode includes other implementations described herein, and the design of snapping and interlock mechanisms for such implementations, such as shown in FIG. 11. The design of the two variant pieces (male and female) enables the two variant pieces to connect, snap and lock together on all sides (male to female, and female to male) and to thereby contiguously build out in any direction. See FIGS. 8-10.

The ability of the two variant pieces to universally connect on all sides allows the design and construction of models or block creations using the pieces only, achieving complete continuity in the design and build of the model without the need of connectors, rods, clips or other snapping components. As further described herein, the snapping and locking moment (male to female, and female to male) is achieved through a designed "squeeze" or "interference" under which the female piece holds and locks the male piece on the particular side being connected once the two pieces are snapped together. The implementation is further described herein, and each snapping mode is shown in FIGS. 5-7. Examples of variable designs for the snapping mechanisms pertaining to the three modes are shown in FIGS. 11-13.

As will be readily appreciated from the foregoing, a snapping block toy is provided that includes a female and a male cubic unit piece wherein all sides of the female piece, including the snapping and interlock design, are identical, and all sides of the male piece, including the snapping and interlock design, are identical, thereby enabling the female piece and the male piece to be snapped together using any side of the female piece or male piece. Additionally, the block designs further enable construction of models or creations with such pieces that can be contiguously built out indefinitely in any direction.

Moreover, the snapping block toy further provides the advantage of multiple piece size scales manageable by the human hand, multiple male-to-female interference snapping mechanisms including flat flush interlocking surfaces, convex and concave flush interlocking surfaces, and the aforementioned interlocking surface faces accompanied by snapping bumps, ramps, and grooves on either the male or female snapping face, all of which can snap and interlock together using any of the six faces of the male and female cubic pieces.

In addition, the implementations of the present disclosure enable the use of electronics and circuitry piece integration, including, without limitation, basic conductor pieces, pieces that illuminate, pieces that sense various physical data such as light, sound, temperature, and smell, as well as pieces that communicate data via wireless routers, pieces that communicate data via Bluetooth, pieces that take photos or video, and servomotor pieces that enable movement.

As will be further appreciated from the foregoing, the present disclosure provides for completely contiguous cubic snapping in all directions. The universal snapping unit cube such as disclosed herein allows for an unprecedented degree of representational resolution and design options for modeling ideas and for creative exploration. A universal snapping system disclosed herein solves both problems described above at once—firstly, because all faces are snapped between adjacent units, the model will be sturdy and complete at all scales; and secondly, the user does not have to rely on unique pieces or separate snapping or connecting components to expand their model outward in any direction.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with modular blocks, interlocking block and puzzle pieces, computers, microprocessors, personal communication devices, tables, and the like have not been shown or described in order to avoid unnecessarily obscuring descriptions of the various implementations of the present disclosure.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations. In addition the words "channel" and "groove" are used interchangeably throughout.

The figures are provided (a) to further describe the present disclosure, (b) to show certain implementations or permutations of the present disclosure, and (c) to show enablement, function, and use thereof. However, the figures are not visually to scale, although annotated dimensions on certain embodiments or permutations are true to form. It is to be understood that the description herein and the accompanying figures describe certain implementations, versions, and permutations of the present disclosure and are not intended to be exclusive.

Summary of Universal Snapping Modular Block System

Figure 1:
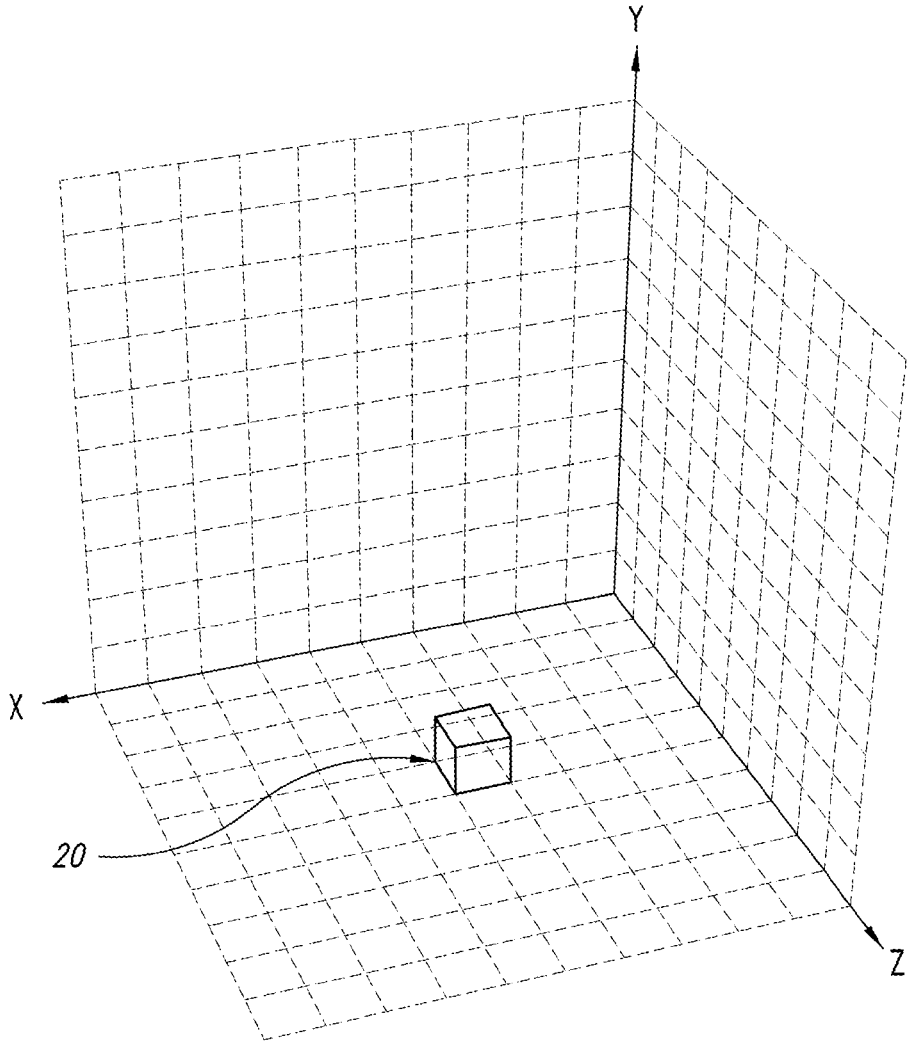
FIG. 1 is an illustration of a cubic base unit formed in accordance with the present disclosure.
Figure 2:
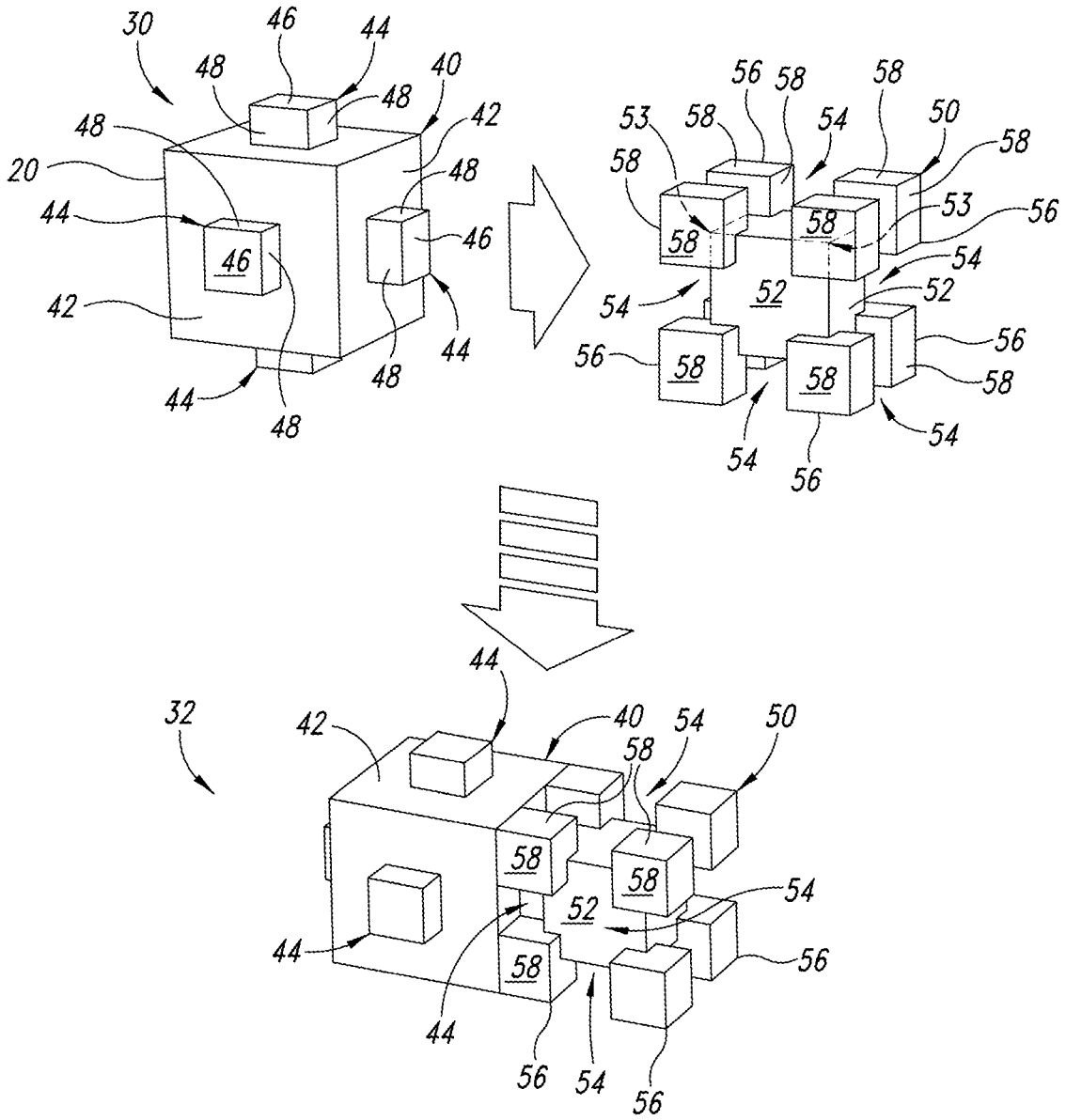
FIG. 2 is a pictorial illustration of the male and female cubic units formed in accordance with the present disclosure utilizing a two-variant system cross channel.
Figure 3:
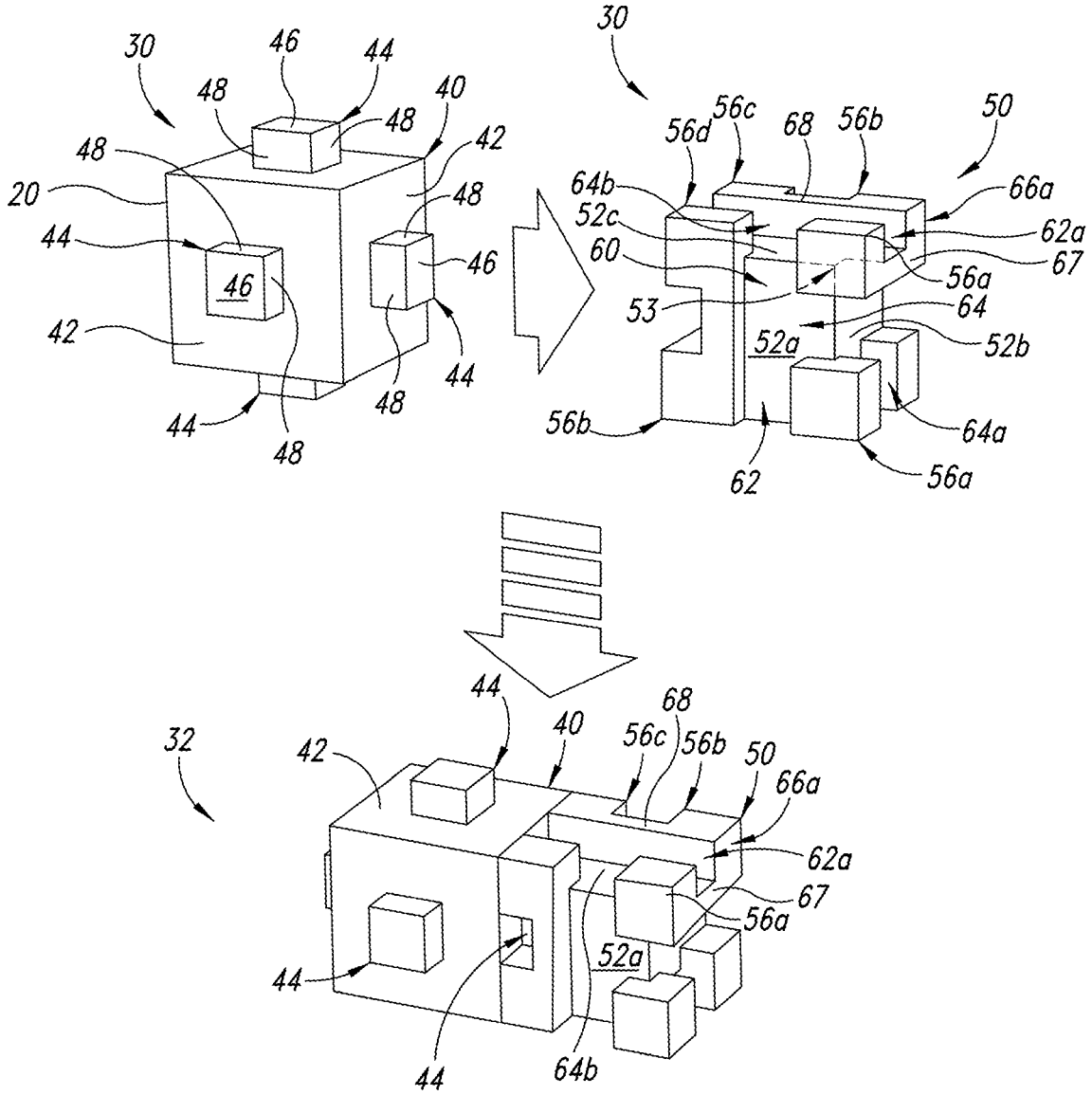
FIG. 3 is a pictorial illustration of the male and female cubic units formed in accordance with the present disclosure utilizing a two-variant system T-channel.
Figure 4:
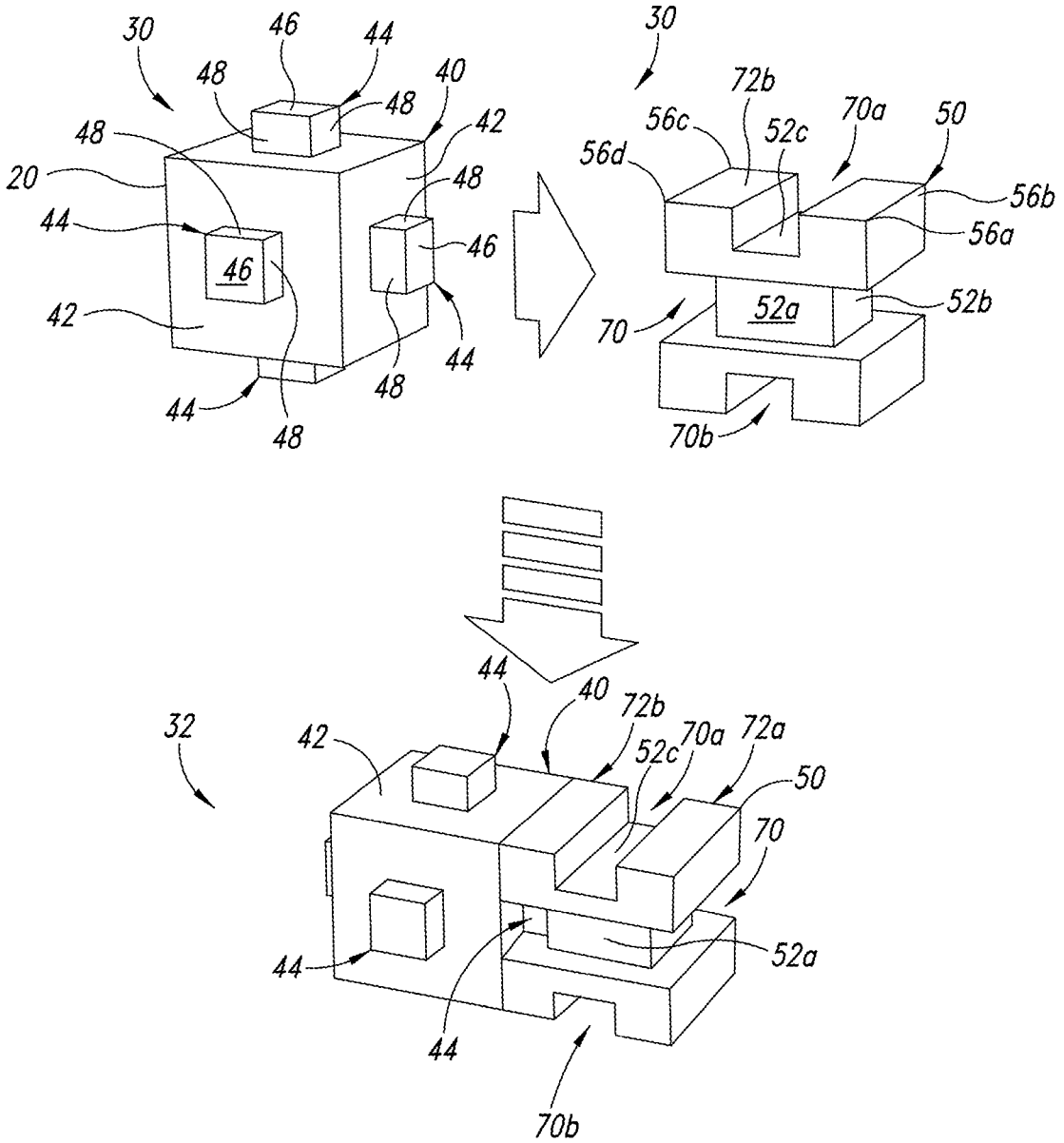
FIG. 4 is a pictorial illustration of the male and female cubic units formed in accordance with the present disclosure utilizing a two-variant system single channel.

The universal snapping modular block system component of the present disclosure is based upon a cubic base unit shown in FIG. 1. The cubic base unit constitutes the smallest divisible volume within the three-dimensional cubic space of the overall geometric system. Unit cubes, along with all other piece types and designs of this implementation, snap and lock together, and achieve complete contiguity, by having two variants of each piece shape type. These variants are shown in FIGS. 2-4. The two variants of each piece type can be thought of as two piece types, female and male, or groove/channel-bearing pieces (female) and node-bearing pieces (male), which snap and lock together by using one's fingertips to push or fit the pieces together on any side.

Figure 8:
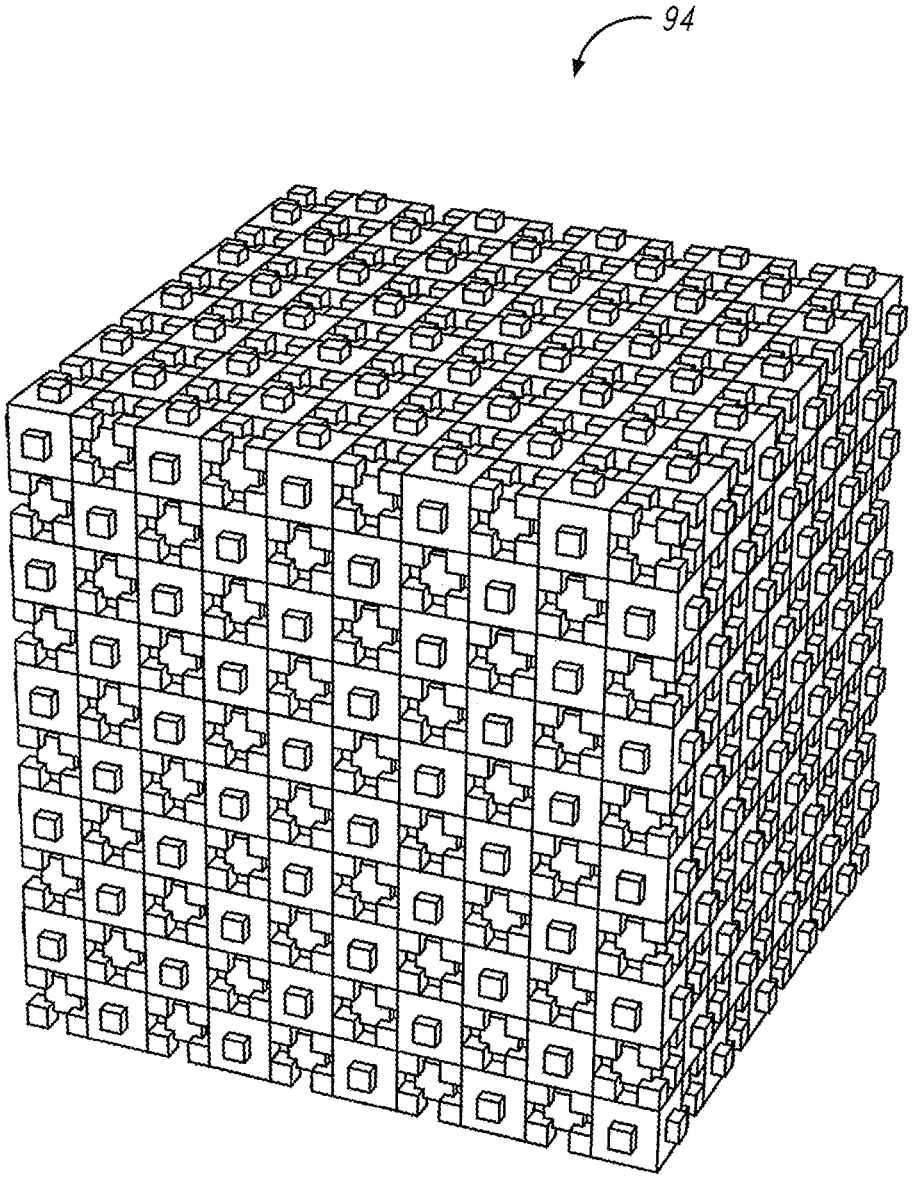
FIG. 8 is a pictorial illustration of a contiguous buildout cross-channel implementation of the present disclosure.
Figure 9:
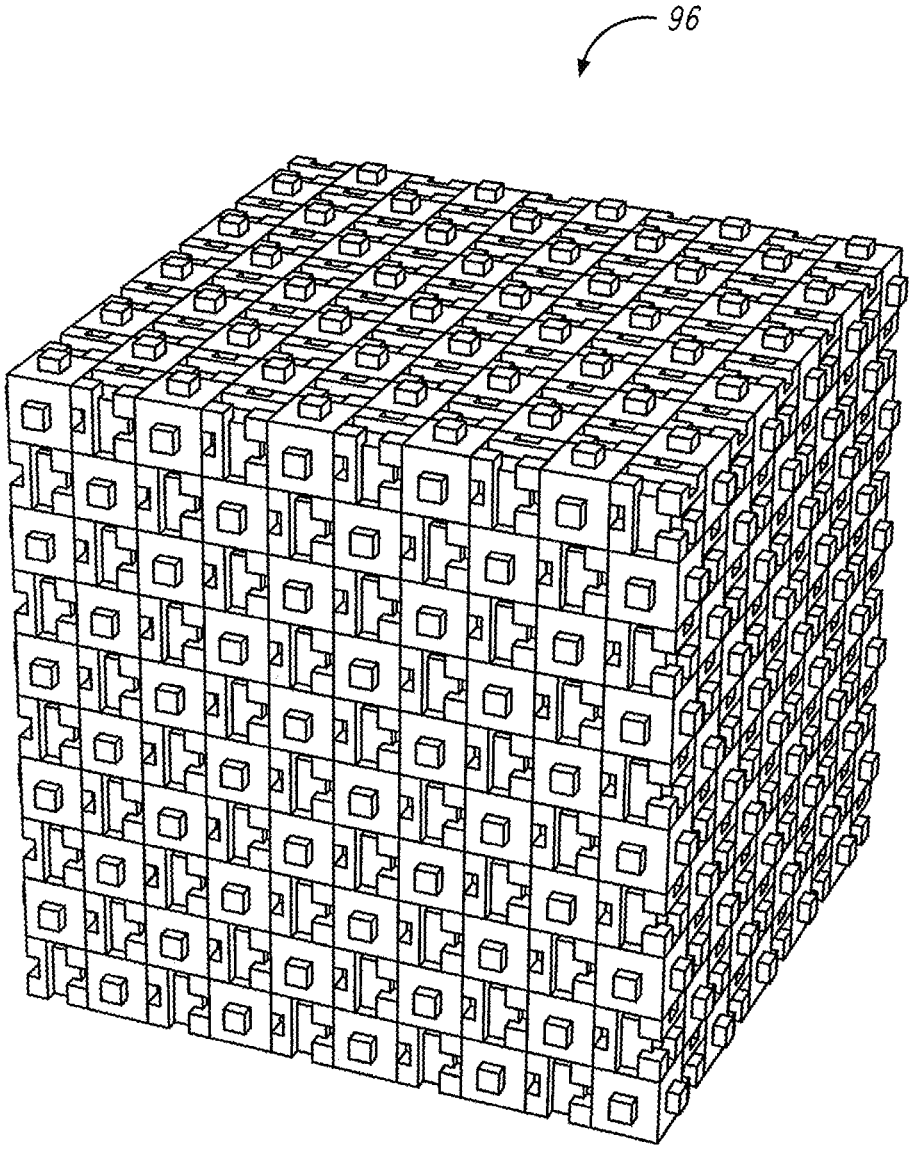
FIG. 9 is a pictorial illustration of a contiguous buildout T-channel implementation of the present disclosure.
Figure 10:
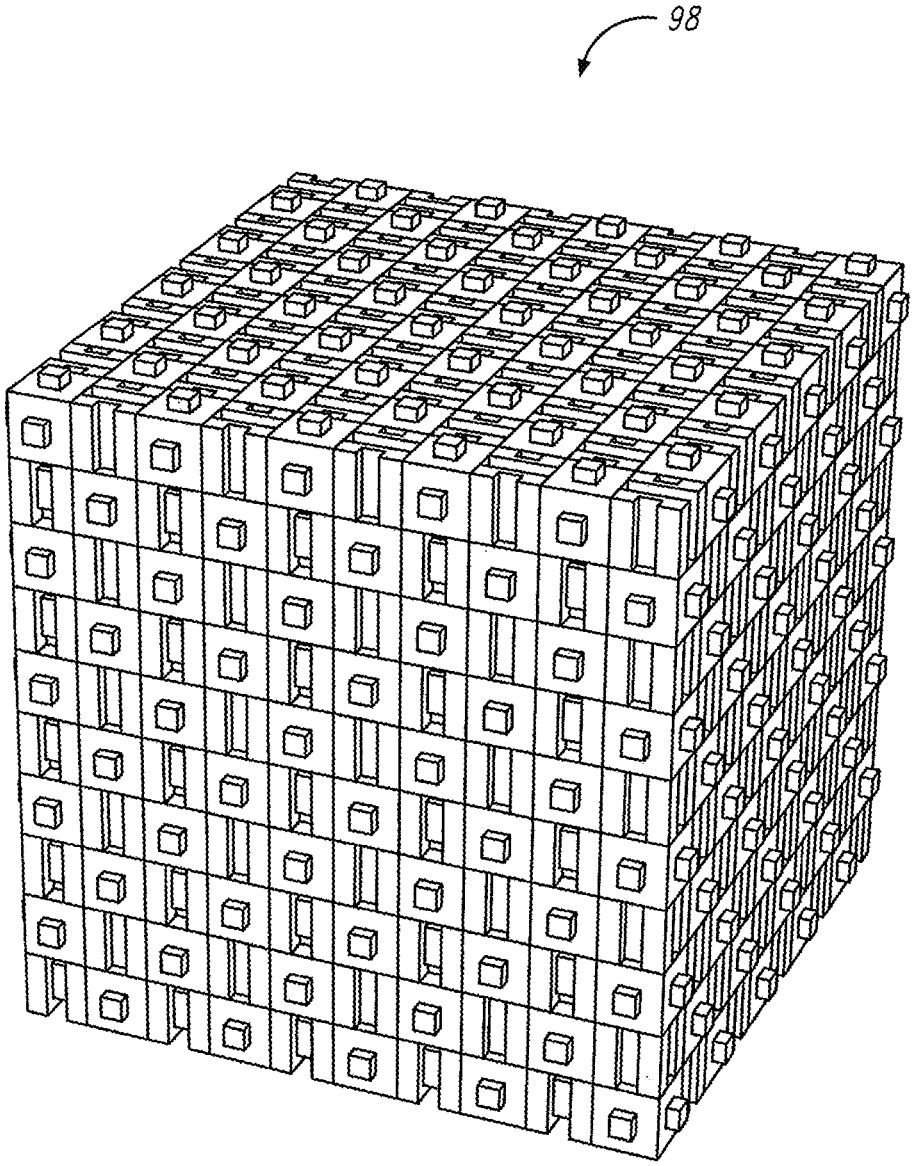
FIG. 10 is a pictorial illustration of a contiguous buildout single-channel implementation of the present disclosure.

With respect to each of the female unit design modes, the female unit cube is designed with an identical female connection design on all six sides. The male unit cube is designed with an identical male connection design on all six sides such that the male unit cube snaps and locks together side to side with any of the different female cube units. (See FIGS. 2-4.) As a result of this two-variant system, the universal snapping modular block system component can contiguously build outward indefinitely, as illustrated in the examples of FIGS. 8-10.

The universal snapping modular block system includes several varying design modes, each of which employs essentially the same two-variant system. As shown in FIGS. 2-4, at any cubic dimensional scale, the design and scale of the male unit is constant in relationship with the female unit, although the exact design of the node on the male piece can be modified if desired. For example, for certain applications and implementations of the present disclosure, the cubic node on the male piece could be designed as a rectangular node that aligns with and snaps into the channel on the female units.

The design of the female unit is in three design modes. The first design mode is referred to herein as the "cross-channel" mode as shown in FIG. 2. The second design mode is referred to herein as the "T-channel" mode, shown in FIG. 3. The third design mode is referred to herein as the "single-channel" mode, which is illustrated in FIG. 4. The three two-variant design modes for the female unit include different snap design implementations referenced and described herein by various names listed in FIGS. 11-13.

Referring initially to FIG. 1 shown therein is a cubic base unit 20 in a 3-D grid display. The cubic base unit 20 forms the primary geometric shape upon which the pieces of the modular block toy are designed and formed.

FIG. 2 illustrates a modular block toy 30 and corresponding system 32 that are formed on the cubic base unit 20. More particularly, the toy 30 and system 32 include a male cubic unit piece 40 having a plurality of faces 42, with a male node 44 extending from each respective face 42 of the plurality of faces. The male node 44 has a preferred geometric shape of a cube that includes a top face 46 and four side faces 48. Ideally the male node 44 is centered in the respective face 42 of the male cubit unit piece 40.

The toy 30 and system 32 also include a female cubic unit piece 50 having a plurality of faces 52 and corners 53 (shown in phantom) formed by three intersecting faces 52. A female component in the form of at least one channel 54 is located on a respective face 52 of each of the plurality of faces that is sized and shaped to receive a respective male node 44 from the male cubic unit piece 40, preferably with an interference fit, thereby enabling the female piece 50 and the male piece 40 to be removably connected together using any side or face 52 of the female piece 50 and any side or face 42 of the male piece 40. Ideally the interference fit is such that it enables manual assembly and disassembly by the human hand.

In the implementation shown in FIG. 2, there are two intersecting channels 54 on each face 52 of the female piece 50 that form a cross-shaped channel. More particularly, each channel 54 is formed by a protuberance 56 formed on each corner 53 to extend onto each face 52 adjacent to the respective corner 53 to define the female component as a cross-shaped channel 54. In this implementation, each protuberance 56 has a cuboid shape, such as a cube, with six faces 58. Preferably the protuberance is sized and shaped to either have an opening to fit over the corner 53 of the female piece 50 or vice versa, the female piece has an opening sized and shaped to receive a corner of the protuberance 56, and the two pieces are permanently attached such as with adhesive. In another implementation, the protuberance 56 is integrally formed with the female piece 50 in a manner of construction that is known to those skilled in the art, such as molded plastic.

Also shown in FIG. 2 is the system 32 formed by the cooperation of the male and female pieces 40, 50. As shown in the lower portion of FIG. 2, a male node 44 on the male piece 40 is frictionally received within a groove 54 of the female piece 50 such that the female piece 50 is held adjacent to the male piece 40. In other words, the respective side faces 48 of the male node 44 are in frictional contact with the abutting faces 58 of the protuberances 56 that define the channel or groove 54 in which the male node 44 is received. Preferably the height of the male node 44 (i.e., the distance the top face 46 extends or projects from the respective surface or face 42) is the same or less than the a depth of the groove 54 (i.e., the distance between the surface 52 of the female piece 50 and the corresponding parallel face 58 of the protuberance 56) to enable the female piece 50 to be flush against the male piece 40 (i.e., the respective four faces 42 of the male piece 40 are in contact with and abut the respective four faces 58 of the abutting protuberances 56).

It will be appreciated that in use, the male node 44 may be placed at any location along the groove 54, providing countless variations in the shapes that can be created with these two pieces.

In FIG. 3 is illustrated an alternative implementation of the female piece 50. The male piece 40 remains unchanged in this implementation. For convenience and ease of understanding, like or similar pieces retain the same reference numbers throughout the drawings. Here, the female piece 50 has a T-shaped female component or groove 60 formed of two intersecting channels or grooves 62, 64. More particularly, an elongate groove 62 forms the cross-piece and a shorter groove 64 forms the stem of the T-shaped groove 60 on each face 52. The T-shaped groove 60 is formed by cooperating L-shaped protuberances 66*a* (three L-shaped protuberances 66*a* for each female piece 50) that cooperate to define the respective grooves 62, 64. Each L-shaped protuberance 66*a* is formed on three corners 53 of the female piece 50 to extend onto each face 52 adjacent to the respective corner 53, and each L-shaped protuberance 66*a* has three respective corner protuberances 56 as described above that are referred to in this implementation as corner pieces 56*a*, 56*b*, and 56*c*.

Hence, in this implementation, representative L-shaped protuberance 66*a* has a first corner 56*a* piece that is connected to an adjacent second corner piece 56*b* by a lower connector 67, and the second corner piece 56*b* is connected to the third corner piece 56*c* by an upper connector 68. The lower connector 67 is sized and shaped to be flush with a top face 52*c* to form the elongate groove 62*a*, and further to extend onto a side face 52*b* to form a projecting wall that defines a terminal wall for a corresponding shorter groove 64*a* on the side face 52*b*. Similarly, the upper wall or connector 68 forms a projecting wall on the top adjacent face 52*c* that defines a terminal wall for another shorter groove 64*b* on the top face 52*c*, and it is flush with an adjacent face (not shown) to form a portion of a respective elongate groove (not shown) in the manner as described above with respect to elongate groove 62*a*.

In this implementation, the system 32 illustrated at the bottom of FIG. 3 functions similarly to that described above with respect to FIG. 2. The male node 44 frictionally engages the female piece 50 at a selected location within a respective T-shaped groove 60 with an interference fit.

In FIG. 4 is illustrated a further implementation of the toy 30 and system 32 in which the male piece 40 is the same as described above and the female piece 50 is further modified to use single channels or grooves 70 on each respective face 52. The grooves 70 on each side face 52*a*, 52*b*, and adjacent side faces, not shown, merge to form a single circumscribing groove around the female piece 50. A top groove 70*a* is formed by merging two adjacent protuberances or corner pieces 56*a*, 56*b* to be a first single rectangular protuberance 72*a*. In a similar fashion, the other side of the top groove 70*a* is formed by merging the two protuberances 56*c*, 56*d* to form a second single rectangular protuberance 72*b*. The groove 70*a* formed between the first and second rectangular protuberances 72*a*, 72*b* is sized and shaped to accommodate a male node 44 with an interference fit anywhere along a length of the top groove 70*a*.

In a similar fashion, a second or lower groove 70*b* is formed on the bottom face of the female piece 50. As shown in FIG. 4, the two grooves 70*a*, 70*b* are in spaced parallel relationship. However, it is to be understood that the two grooves 70*a*, 70*b* may be oriented so their longitudinal axes are at right angles)(90° to one another.

Figure 5:
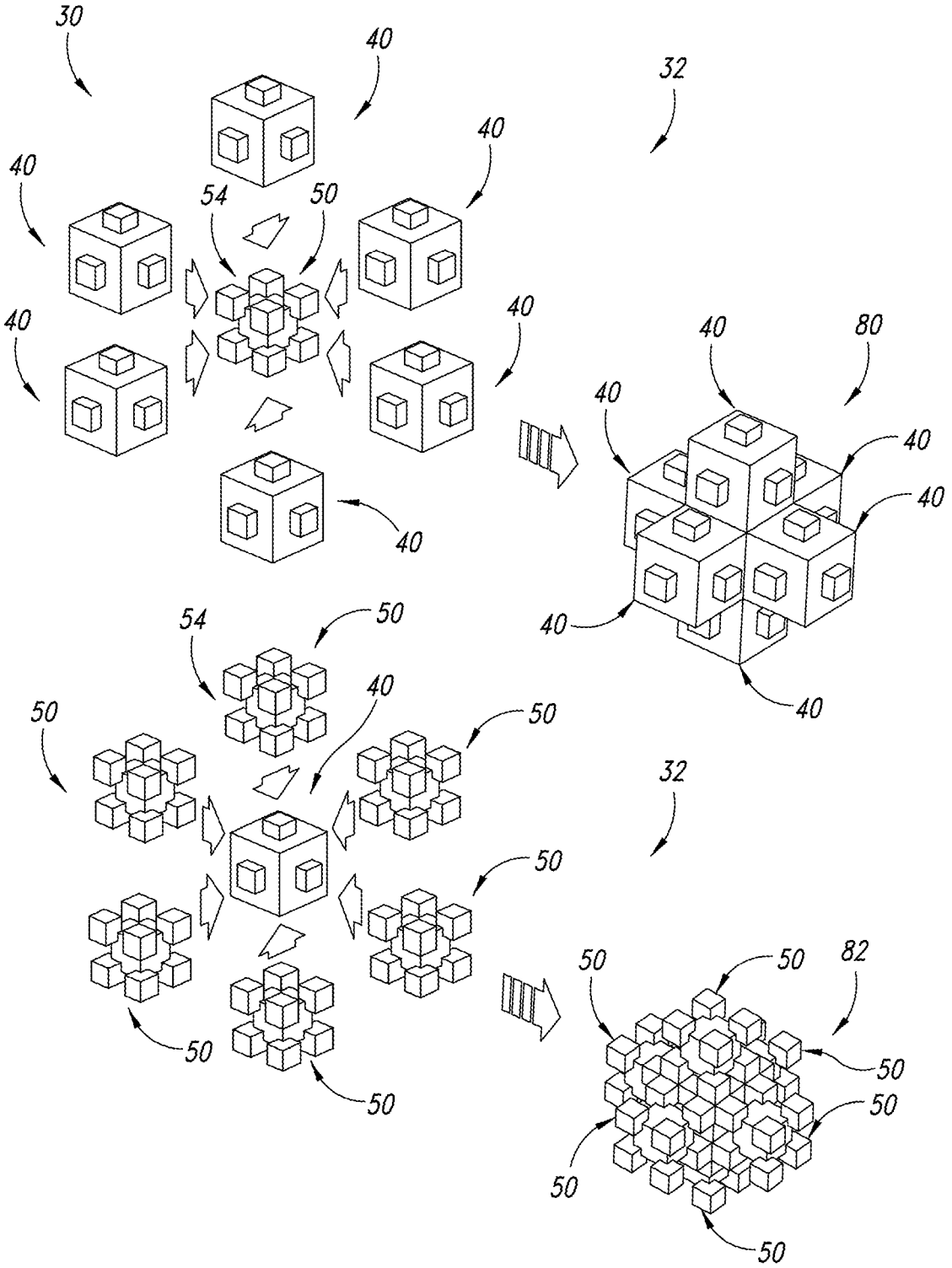
FIG. 5 is a pictorial illustration of the male and female cubic units formed in accordance with the present disclosure utilizing a snapping action cross channel.
Figure 6:
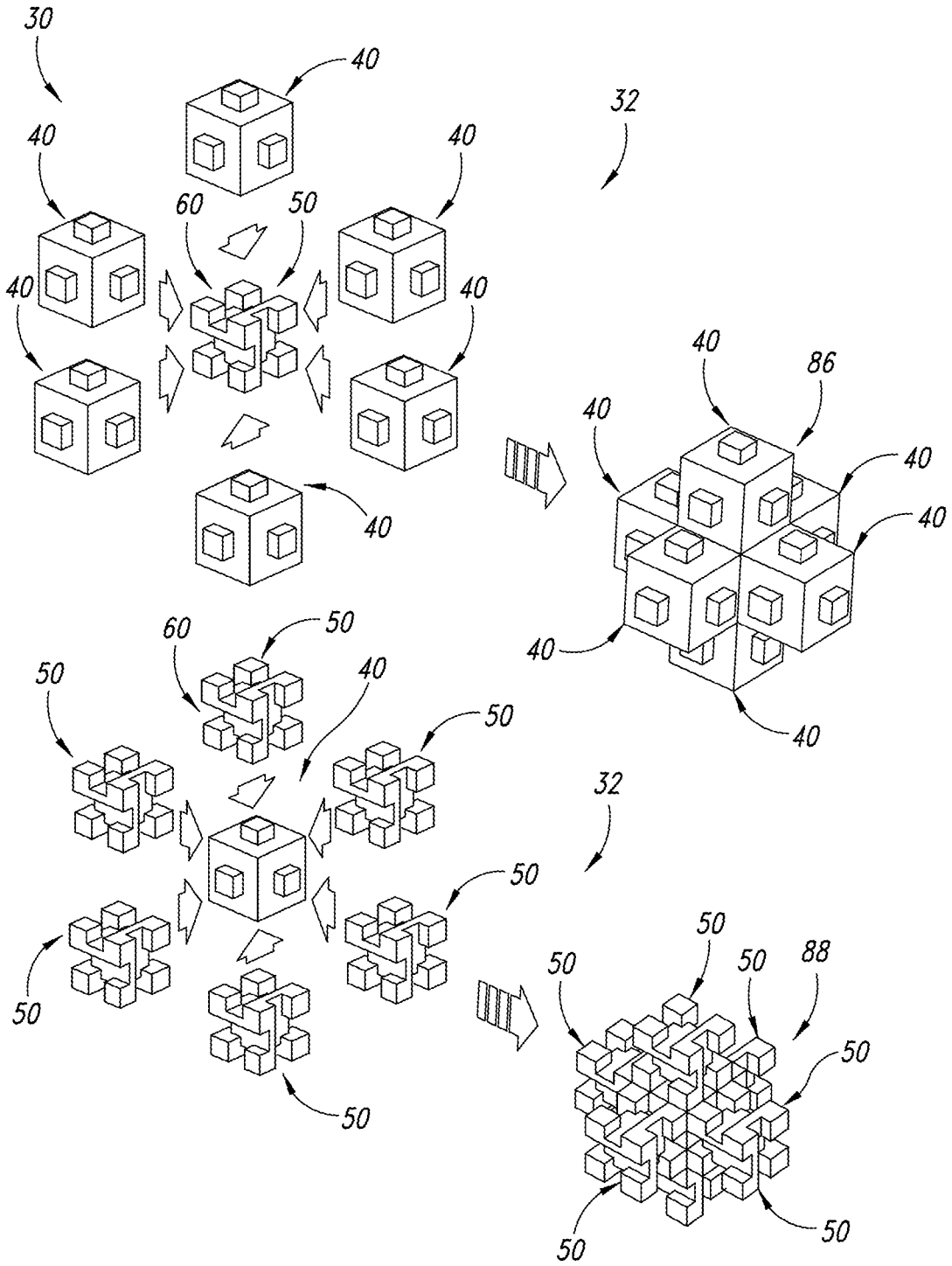
FIG. 6 is a pictorial illustration of the male and female cubic units formed in accordance with the present disclosure utilizing a snapping action T-channel.
Figure 7:
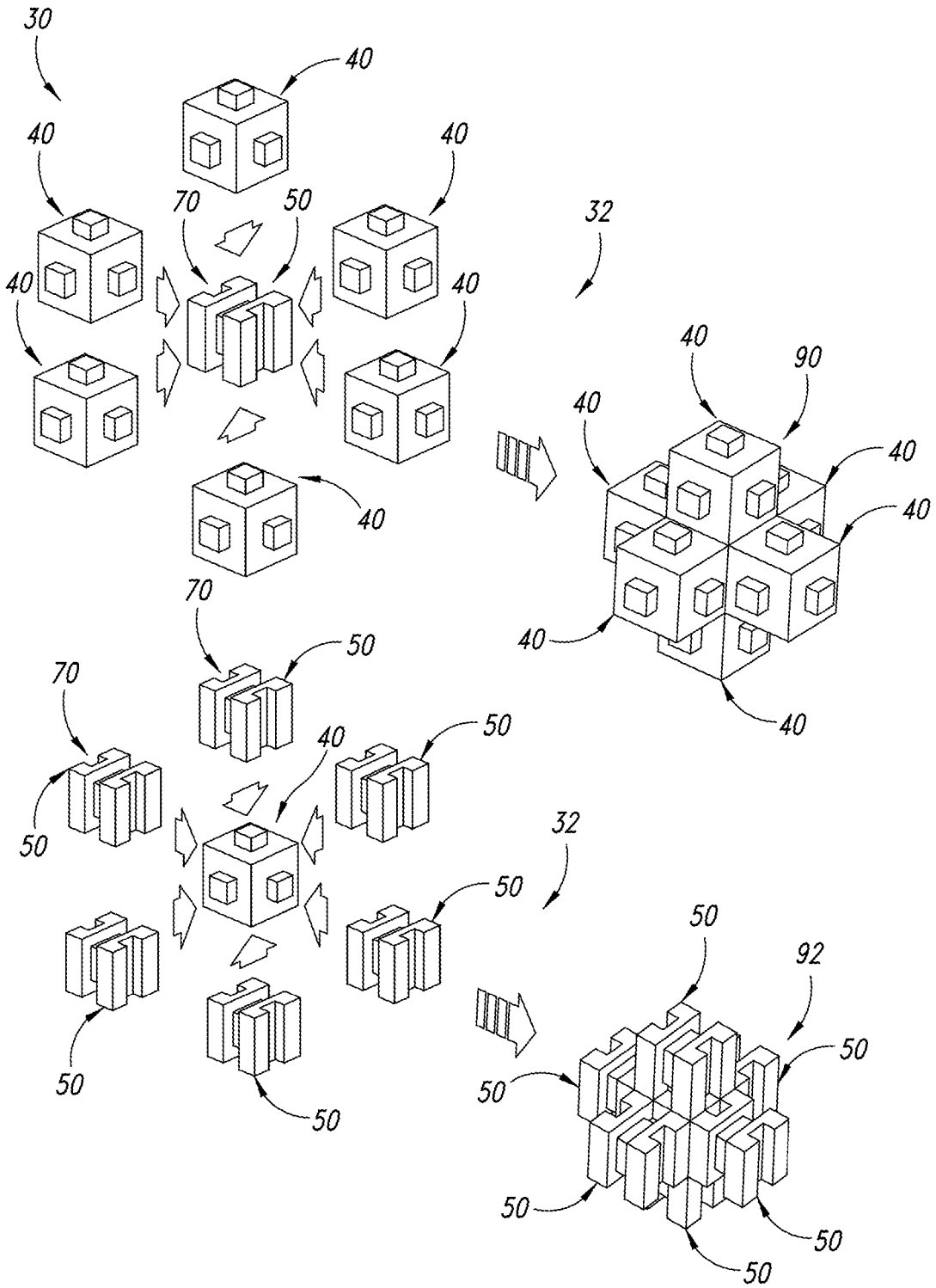
FIG. 7 is a pictorial illustration of the male and female cubic units formed in accordance with the present disclosure utilizing a snapping action single channel.

As depicted in FIGS. 5-7, with the cross-channel mode, T-channel mode, and single-channel mode, a node on each side of the male piece snaps or slides into the center of the intersecting grooves/channels on each side of a female piece (or vice versa) through an interference lock located at the center of the female piece, where the male and female pieces lock together. Interference lock permutations are found on the female piece of each two-variant mode (cross-channel, T-channel, single-channel) and can include slopes, ramps, grooves, bumps, or curves on each side to enable snapping (i.e., sliding the male piece and female piece together) into the locked position (see FIGS. 11-13).

One use of the toy 30 is shown in FIG. 5, which depicts two current implementations of the system 32, a male cluster 80 in the top half of the figure and a female cluster 82 in the bottom half of the figure formed from the cross-channel variant of the toy 30. In the male cluster 80, a male piece 40 is attached to each side of the six sides of the female piece 50 so that only the six male pieces 40 are visible in the assembled cluster 80. Similarly, in the female cluster 82, a female piece 50 is attached to each of the six sides of the male piece 40 so that only the six female pieces 50 are visible. It is to be understood that these two clusters 80, 82 illustrate but one technique for assembling male and female pieces 40, 50. For example, different permutations of these structures can be formed by using only one, two, three, four, or five pieces with the respective opposite piece.

The T-channel and the single-channel versions of the toy 30 are shown in FIGS. 6 and 7 respectively. In FIG. 6 there are shown a male cluster 86 and female cluster 88, and in FIG. 7 are shown a male cluster 90 and female cluster 92. Each of the clusters 86, 88, 90, 92 are constructed as described above with respect to FIG. 5, except the male and female pieces 40, 50 are formed with the T-channel construction to form the male and female clusters 86, 88, and are likewise formed with the single-channel construction to form the male and female cluster 90, 92.

In FIGS. 8, 9, and 10 are shown additional assemblies that can be formed using the three variations of the male and female pieces 40, 50. More particularly, FIG. 8 is a pictorial illustration of a contiguous buildout cross-channel implementation 94. FIG. 9 is a pictorial illustration of a contiguous buildout T-channel implementation 96, and FIG. 10 is a pictorial illustration of a contiguous buildout single-channel implementation 98. The contiguous buildout examples are constructed with multiple male and female pieces, and illustrate that there are no dead ends (i.e., the pieces can snap together indefinitely in any direction). On any face of the buildout examples, additional male and female pieces can be attached to create further protections, including cubic or rectangular projections.

In accordance with another implementation of the present disclosure, the protuberances on the female pieces and the nodes on the male pieces are designed and formed to have a more secure engagement. Representative implementations of several designs are depicted in the accompanying figures and are described in more detail below. It is to be understand that these are only a few non-limiting examples, and other configurations are possible. In addition, design variations in the size and shape of the female and male pieces, as well as the various geometric shapes that may be chosen for the protuberances, projections, nodes, channels, and grooves, are possible that may be chosen for aesthetic purposes unrelated to the function thereof, including symmetry, balance, and radius of curvature, to name a few.

In FIGS. 11A-11F are shown six variations of structural configurations to provide for an enhanced interference fit between a female piece 100 and a male piece 102. It is to be understood that these drawings are not to scale and certain features are illustrated with an exaggerated size to more clearly show the concept. These six figures show the female piece 100 in cross-section with the cross-channel configuration as illustrated and described in connection with FIG. 2 above. In FIGS. 11A-11F, an interior corner of all four protuberances 104 are formed with a radially inward extending ramp 106 with a distal face 108. The distal face 108 may have beveled edges 110 on one or both sides. The length of the ramp 106 is such that it will extend to and slightly past a male node 112 on the male piece 102.

More particularly, the male node 112 has beveled faces 114 on each of its four corners that are substantially parallel to the respective distal face 108 on the female piece 100. The size of these distal and beveled faces 108, 114 will depend on the amount of overlapping area 116 to be provided between the protuberances 104 and the male node 112.

Figure 11A:
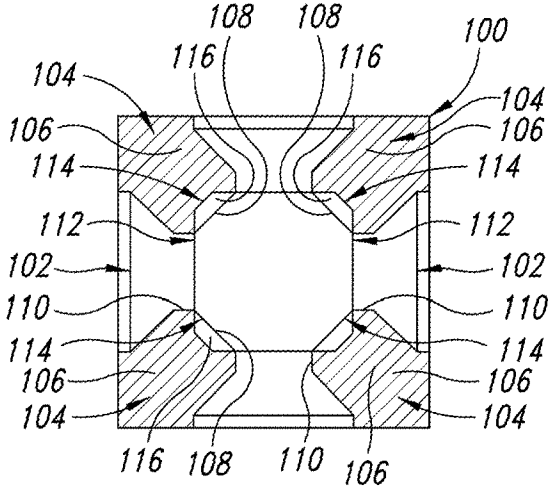
FIGS. 11A-11F are illustrations of cross-channel interference lock implementations formed in accordance with the present disclosure.
Figure 11B:
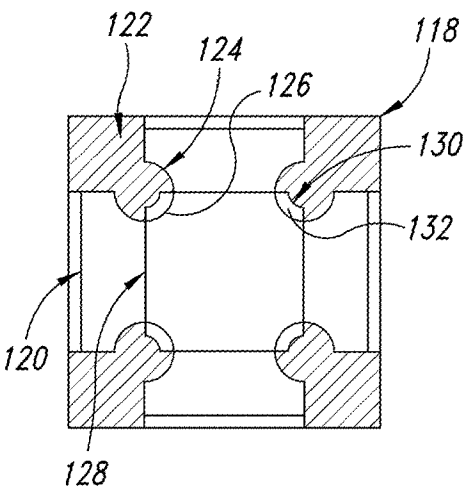
Figure 11C:
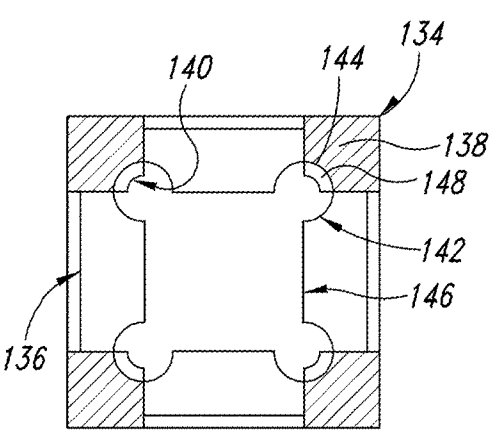

An alternative design is shown in FIG. 11B in which a female piece 118 cooperates and engages with a male piece 120 with modified protuberances 122. An interior corner of each protuberance 124 is shaped as a cylinder having a circular cross-sectional shape that forms an arcuate, convex distal wall 126 that is sized to extend past a male node 128. In this implementation the male node 128 has an arcuate, concave corner 130 with a radius of curvature that ideally is concentric with the radius of curvature of the distal wall 126. It is to be understood that the size of the cylinder and the radius of curvature of these elements can be varied for aesthetic purposes. An area of overlap 132 is shown in gray. In FIG. 11C, these features are reversed so that the female piece 134 and the male piece 136 engage each other via a protuberance 138 having an arcuate, concave interior corner 140 on the female piece 134 and a cylinder-shaped corner 142 having an arcuate, convex outer wall 144 on the male node 146 with a radius of curvature that is concentric with the radius of curvature of the concave corner 140. Again, the area of overlap 148 is shown in gray.

Figure 11D:
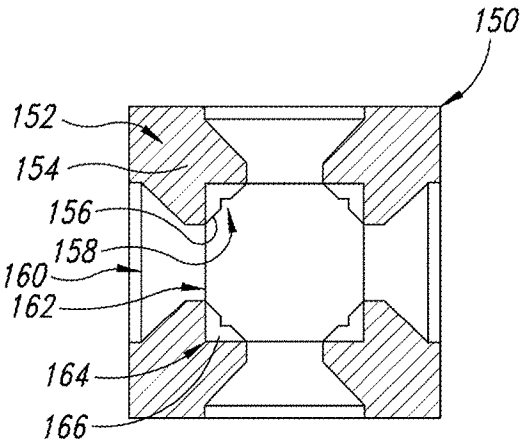
Figure 11E:
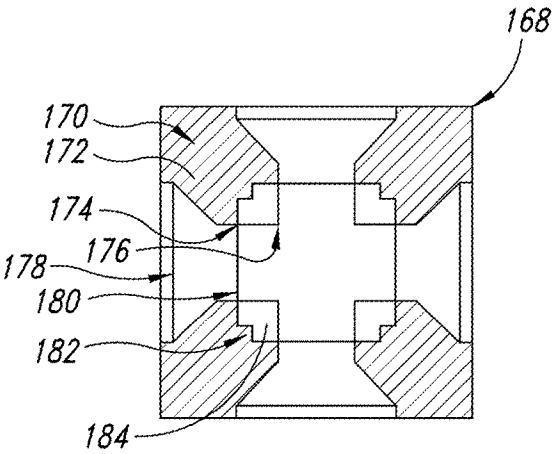
Figure 11F:
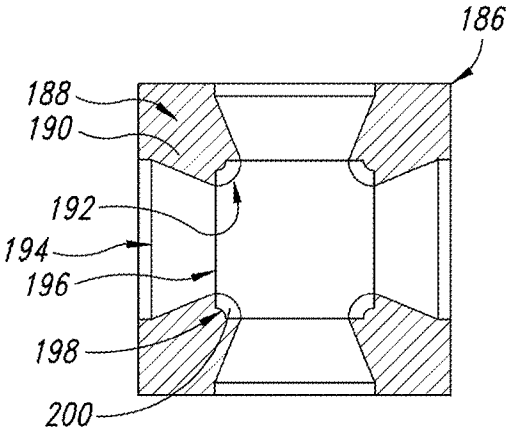

With respect to FIGS. 11D-F, shown therein are alternate versions of a female protuberance distal face with corresponding male node corner. In FIG. 11D the female piece 150 has protuberances 152 with a ramp 154 on the interior corner on which is formed a distal face 156 having a centrally disposed right angle indent 158. On the male piece 160, the male node 162 has unmodified right angle corners 164 that is are sized to have an overlap 166 with the ramp 154 on the female piece 150. In FIG. 11E, the female piece 168 has protuberances 170 with a ramp 172 on the interior corner, on which is formed a distal face 174 having a centrally disposed right angle corner 176. On the male piece 178 the male node 180 has modified right angle indented corners 182 that are sized to have an overlap 184 with the ramp 172 on the female piece 168. And in FIG. 11F, the female piece 186 has protuberances 188 with a ramp 190 on the interior corner on which is formed a rounded distal face 192. On the male piece 194, the male node 196 has modified arcuate, convex corners 198 that are sized to have an overlap 200 with the ramp 190 on the female piece 186.

Figure 12C:
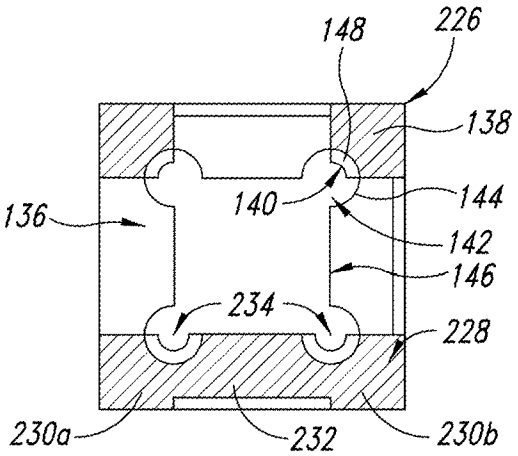
FIGS. 12A-12F are illustrations of T-channel interference lock implementations formed in accordance with the present disclosure.
Figure 12B:
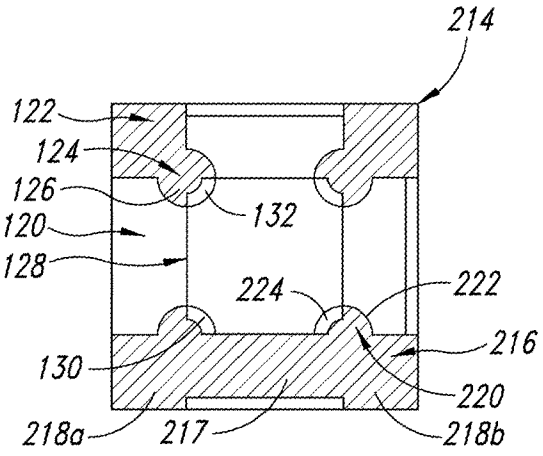
Figure 12A:
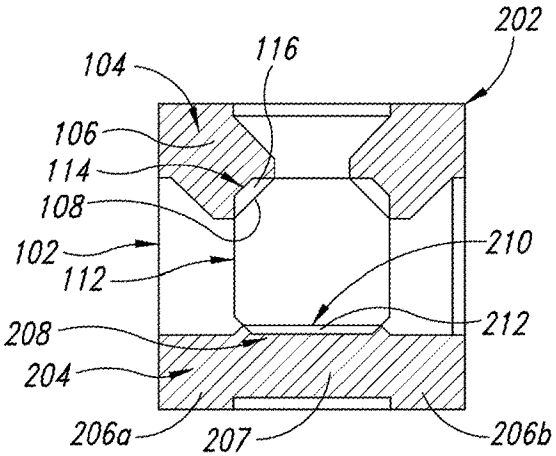
Figure 12F:
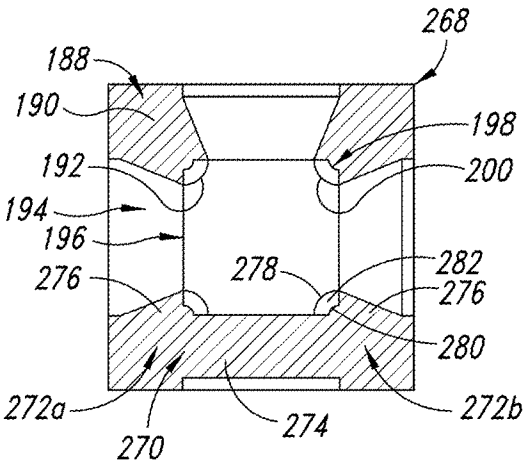

The variations in the female pieces described above can be applied to the T-channel and single-channel implementations, which are shown in FIGS. 12A-12F and 13A-13F. For ease of reference, elements common to these implementations will bear the same reference numbers. FIG. 12A shows a female piece 202 with an elongate rectangular-shaped protuberance 204 consisting of the two corner protuberances 206*a* and 206*b* tied together with a bridge component 207. A ramp 208 projects inwardly towards the male node 112 and beyond to terminate in a distal face 210 and create an overlap area 212. In FIG. 12B the female piece 214 includes the elongate rectangular-shaped protuberance 216 formed of two corner protuberances 218*a* and 218*b* that are connected by a bridge component 217. There are two cylindrical ramps 220 having arcuate, convex outer walls 222 extending inwardly from the elongate protuberance 216 in spaced relationship to overlap respective arcuate concave corners 130 of the male node 128, and form an overlap area 224. In FIG. 12C these elements are reversed, as described above in FIG. 11C, with the female piece 226 having an elongate rectangular-shaped protuberance 228 formed of two corner protuberances 230*a* and 230*b* connected by a bridge component 232, and having two spaced-apart arcuate, concave sections 234.

Figure 12E:
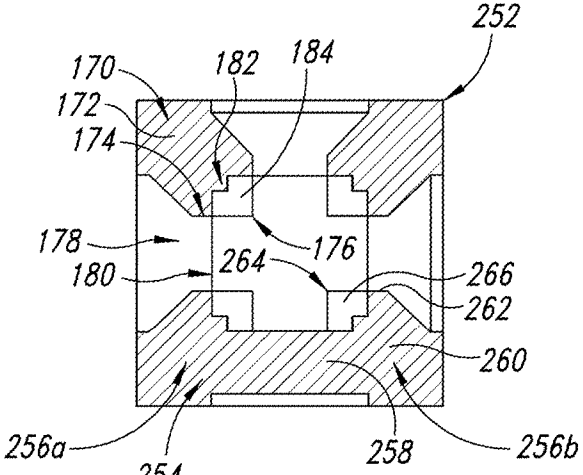
Figure 12D:
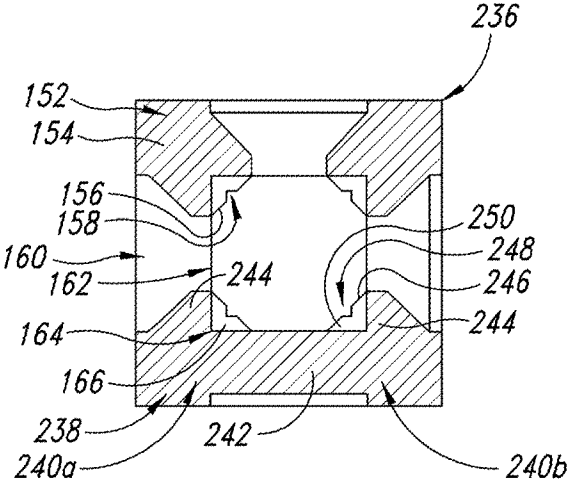

Similarly, in FIG. 12D the female piece 236 includes the elongate rectangular-shaped protuberance 238 formed of first and second corner protuberances 240*a*, 240*b* connected by a bridge component 242. A pair of spaced apart ramps 244 each have a distal face 246 with right angled indent 248 that extend inwardly and past the male node 162 to form an overlap area 250. In this configuration, the ramps 244 have a triangular cross-sectional shape because the bridge component 242 fills in the space that would be formed there-between. In FIG. 12E the female piece 252 includes the elongate rectangular-shaped protuberance 254 formed of two corner protuberances 256*a* and 256*b* connected by a bridge component 258. A pair of spaced apart ramps 260 each have a distal face 262 with right angle exterior corner 264 that extends inwardly and past the male node 180 to form an overlap area 266. In this configuration, the ramps 244 have a partial trapezoidal cross-sectional shape on one edge and square cross-sectional shape on an opposing edge that are joined by the exterior corner 264. This is because the bridge component 258 fills in the space that would be formed there-between. Likewise, in FIG. 12F the female piece 268 has the elongate, rectangular-shaped protuberance 270 formed of the first and second corner protuberances 272*a*, 272*b* connected by a bridge element 274. A pair of spaced-apart ramps 276 with arcuate distal ends 278 extend inwardly and past an arcuate convex corner 280 of the male node 196 to form an overlap area 282.

Figure 13A:
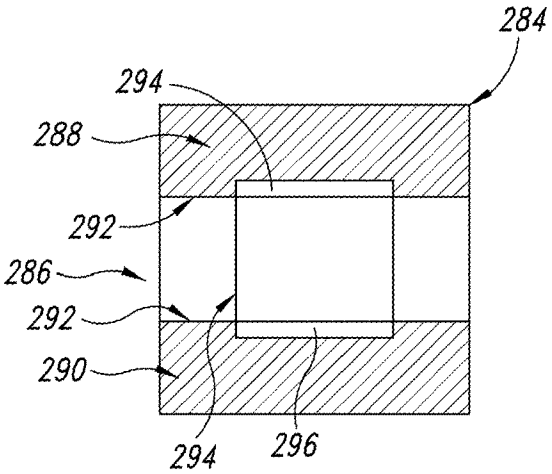
FIGS. 13A-13F are illustrations of single-channel interference lock implementations formed in accordance with the present disclosure.
Figure 13B:
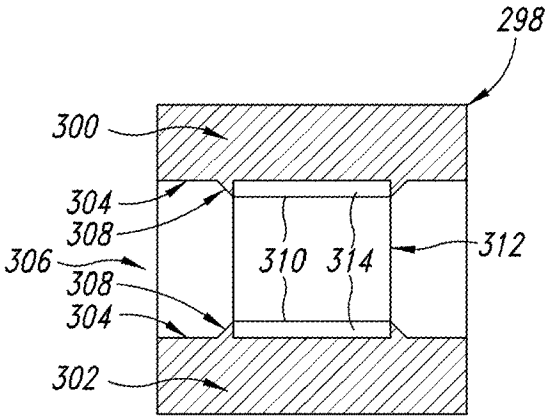
Figure 13C:
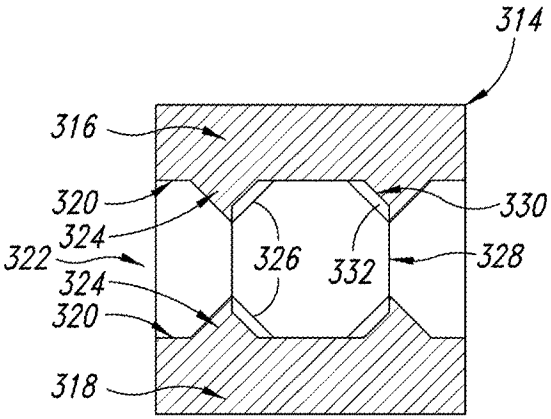

Referring next to FIGS. 13A-13D, shown therein are different implementations of the single-channel female piece and corresponding male node on the male piece. In FIG. 13A the female piece 284 has a single channel 286 formed by opposing first and second protuberances 288, 290 having a rectangular cross-sectional shape. The respective interior walls 292 are spaced apart a uniform distance the length of the channel 286 that is less than a width of the square-shaped male node 294, to create an interference fit, shown by the gray overlapping area 296. FIG. 13B shows a female piece 298 has first and second opposing protuberances 300, 302, with respective interior walls 304 that define a channel 306. A ramp 308 is formed on each interior wall 304 with a distal face 310 to extend into the channel 306 past a male node 312 to form an overlap area 314. And in FIG. 13C a female piece 314 is shown having a pair of opposing protuberances 316, 318 with interior walls 320 that form a channel 322. A pair of spaced-apart bumps 324 are formed on the interior walls 304 of each protuberance 316, 318, which have a triangular cross-sectional shape, although other geometric or non-geometric shapes may be used. Each bump 324 has an interior planar distal face 326 that is sized to extend beyond a male node 328 having beveled corners 330 to form an overlap area 332.

Figure 13D:
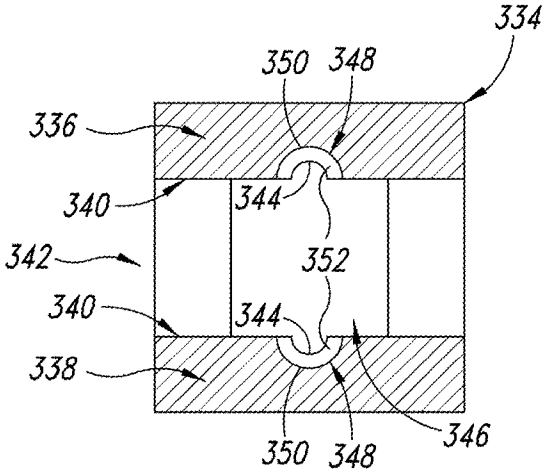
Figure 13E:
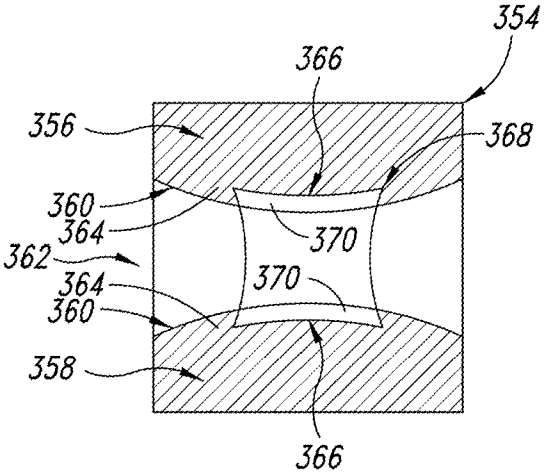
Figure 13F:
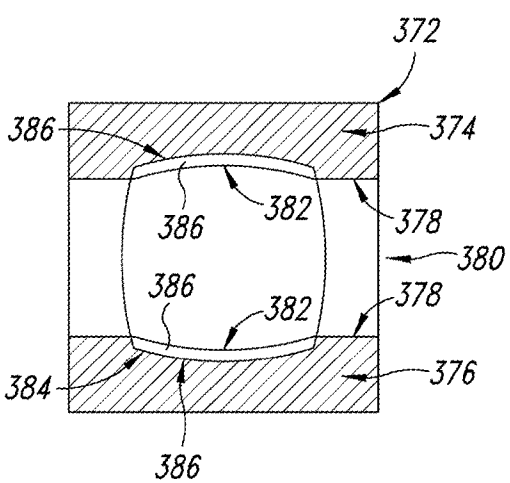

In FIG. 13D the female piece 334 had first and second opposing protuberances 336, 338, with interior walls 340 that define a channel 342. A concave, arcuate indentation 344 is formed half-way through the channel 342. A male node 346 has an external tooth 348 extending from opposing walls with arcuate convex wall 350 that extends into and past the with arcuate indentation 344 to form an overlap area 352. It is to be understood that this configuration can be reversed, with the male node having the arcuate, concave indentation and a corresponding tooth formed on the interior walls of the protuberances. FIG. 13E illustrates a female piece 354 having first and second opposing protuberances 356, 358, each with an interior wall 360, that cooperate to define a channel 362. Each interior wall 360 has an arcuate, convex shape to create a bulge 364 in the middle of the channel 362 that extends beyond a corresponding arcuate, concave exterior wall 366 of a male node 368 to form an overlap area 370 on each side of the male node 368. And similarly, in FIG. 13F is shown a female piece 372 having first and second opposing protuberances 374, 376, each with an interior wall 378, that cooperate to define a channel 380. Each interior wall 378 has an arcuate, concave shape to create an indentation 382 in the middle of the channel 380. The male node 384 has opposing arcuate, convex exterior walls 384 that extend beyond the interior wall 378 to form an overlap area 386 on each side of the male node 384.

As will be appreciated from the foregoing, the interference lock nodes on the female piece, combined with the plasticity of the material of the pieces, are designed to allow the male pieces (i.e., the nodes on the male pieces) to slide together with the female piece past the interlock nodes on either side of the locked position on the female piece into the locked position. In other words, the plasticity (or malleability) of the material allows the transient piece to slide past any interlocking bump, ramp, or snap onto the other piece by deflecting or compressing the male and female interlock nodes sufficiently to allow the piece to pass, and then once in place, the rebound of the material allows the male and female interlock nodes to return to their original shape (or a slightly compressed or squeezed state) with a remaining interference rebound pressure between the female interlock edges and the male node edges, thereby locking (i.e., squeezing) the male piece in place.

Various designs in which this squeeze are accomplished for each two-variant piece mode as described above. The size of the interlock nodes and degree of interference can be varied depending on (a) the plasticity and malleability of the material related to the resistance, deflection, compression, and rebound of the material, (b) the desired resistance and snapping effort when snapping pieces together, and (c) the degree of locking moment preferred once the pieces are locked in place.

In the single-channel flat design described above (FIG. 13A), and at whatever dimensional scale, the male cube piece is identical to the male cube piece used with the cross-channel mode and T-channel mode female pieces. Unlike the cross-channel mode and T-channel mode, there are no interference or interlock nodes on the single-channel flat female piece (FIG. 13A). The interlock is achieved through (a) the fact that the node on the male piece is designed to be slightly wider (the "node width") than the designed width of the channel on the female piece, combined with (b) the plasticity, malleability, resistance and compression rebound of the material, to achieve (c) the desired degree of snapping effort and of locking moment. This locking moment (i.e., the squeeze of the male piece in the locked position with the female piece) is designed and functions through a combination of design size resistance (i.e., male node width is slightly wider than female channel width) and the plasticity, malleability, resistance and compression rebound of the piece material.

The design and mechanics of the single-channel ramped flat female piece (FIG. 13B) allows for sliding a male node-bearing piece into an interlocked position or by inserting perpendicularly a male node-bearing piece into an interlocked position. When sliding a male node 312 into the single-channel ramped flat female piece 298 (and with reference to the example dimensions), the male node 312, in the implementation shown in FIG. 13B, measures 2.667 mm in width and length, easily accesses the female channel 306, which measures 2.717 mm in width, for a length of 1.600 mm along the channel's distance, allowing the male node 312 0.050 mm of wiggle room. After initially sliding into the channel 306, the male node 312 then begins to squeeze between the ramps 308 in the female channel 306, which narrows the channel 306 from 2.717 mm to 2.517 mm over a distance of 0.686 mm. This ramp 308 flattens out at a face 310 and causes a 0.150 mm interference or squeeze on the male node 312 for a distance of 0.381 mm, after which point the male node 312 snaps into its center location in the female channel 306, which measures 2.567 mm wide and holds the 2.667 mm wide and long male square node 312 with a final interference squeeze of 0.100 mm.

As mentioned above, the male node 312 can also be perpendicularly inserted directly into the center of the channel 306, bypassing the sliding action, taking the 2.667 mm wide and long square male node and snapping it directly into the female channel, which measures 2.567 mm in the center, facilitating the same 0.100 mm interference squeeze lock in the end. A single-channel ramped flat piece design with 0.100 mm interference between the male and female locking features is a non-limiting variation as explained above.

Features Common to All Two Variant Modes

Figure 15:
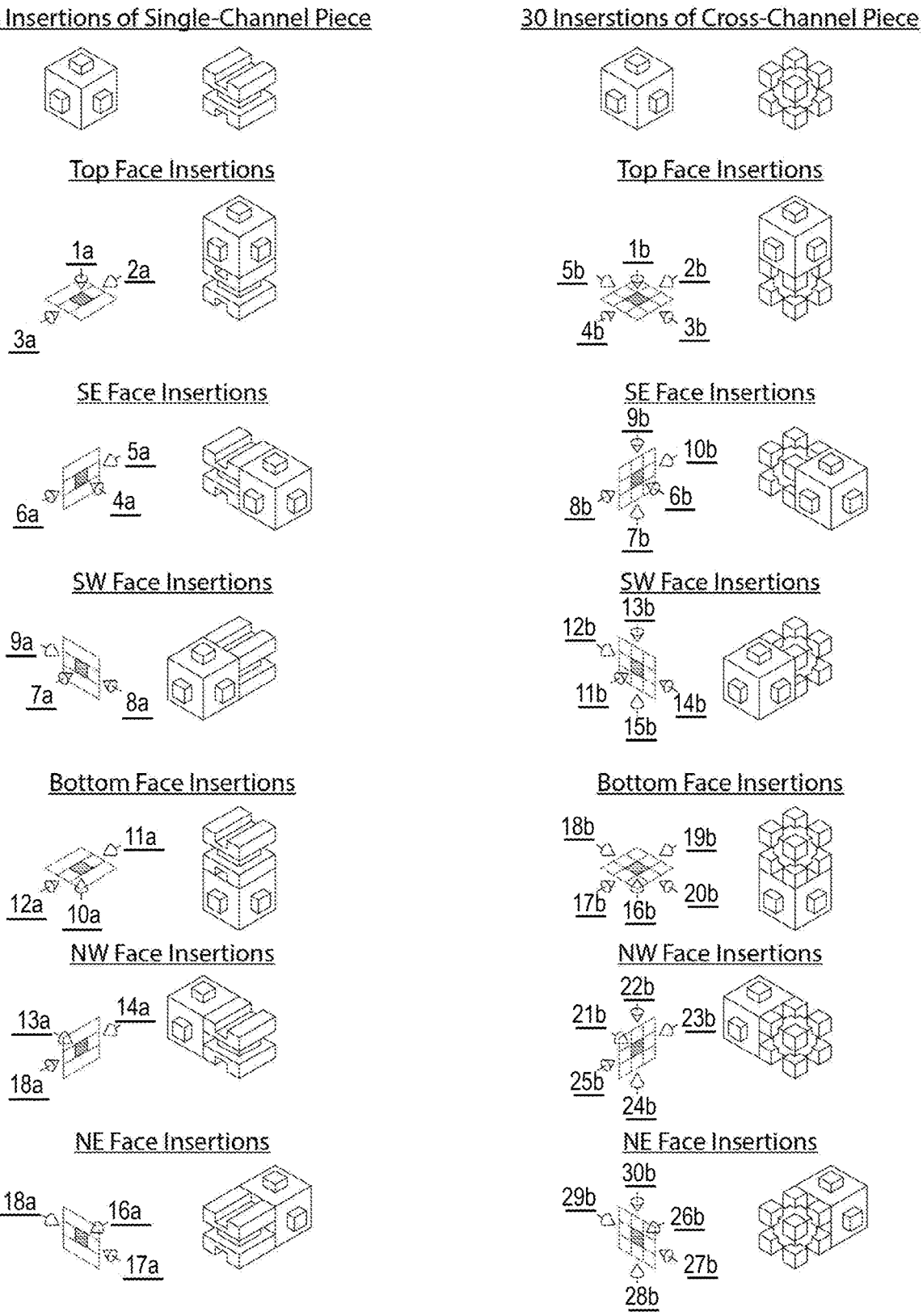
FIG. 15 illustrates various unique trajectories of insertion between a groove-bearing piece (female) and a node-bearing piece (male)

With reference to the three two-variant modes (cross-channel, T-channel, and single-channel), all two-variant pieces snap and lock together, male to female or female to male, as illustrated and described herein. Once in the locked position, the two pieces may be unlocked and unsnapped by sliding them in the opposite reverse direction, or by sliding them apart in one of the other potential directions allowed by the channels on the female pieces. The multiple directions in which the male pieces and female pieces may be snapped together (i.e., inserted together) are shown in FIGS. 5-7. Male pieces may be inserted perpendicularly into the channel on the female piece or by sliding the node on the male piece into and through the channel on the female piece from either end of the channel to the center locked position. Reference is also had to FIG. 15, described below, for additional discussion and disclosure of the foregoing features.

This is to say that there are no dead ends in the user buildout of a model using the two individual cubic base unit male and female pieces with any of the three two-variant piece modes, being unrestrained by adjacent pieces, and snapped and locked together piece side to piece side in any one of the described different directions. On both the male piece nodes and the female piece channels, all edges can be slightly rounded to facilitate the snapping action and effort. The design of the male piece nodes and the female pieces can also accommodate and include bumps of various shapes as part of the snapping action in order to better establish and confirm the centered locking position. The bumps could be on the male piece nodes or on the female piece channels or possibly on both.

Figure 14:
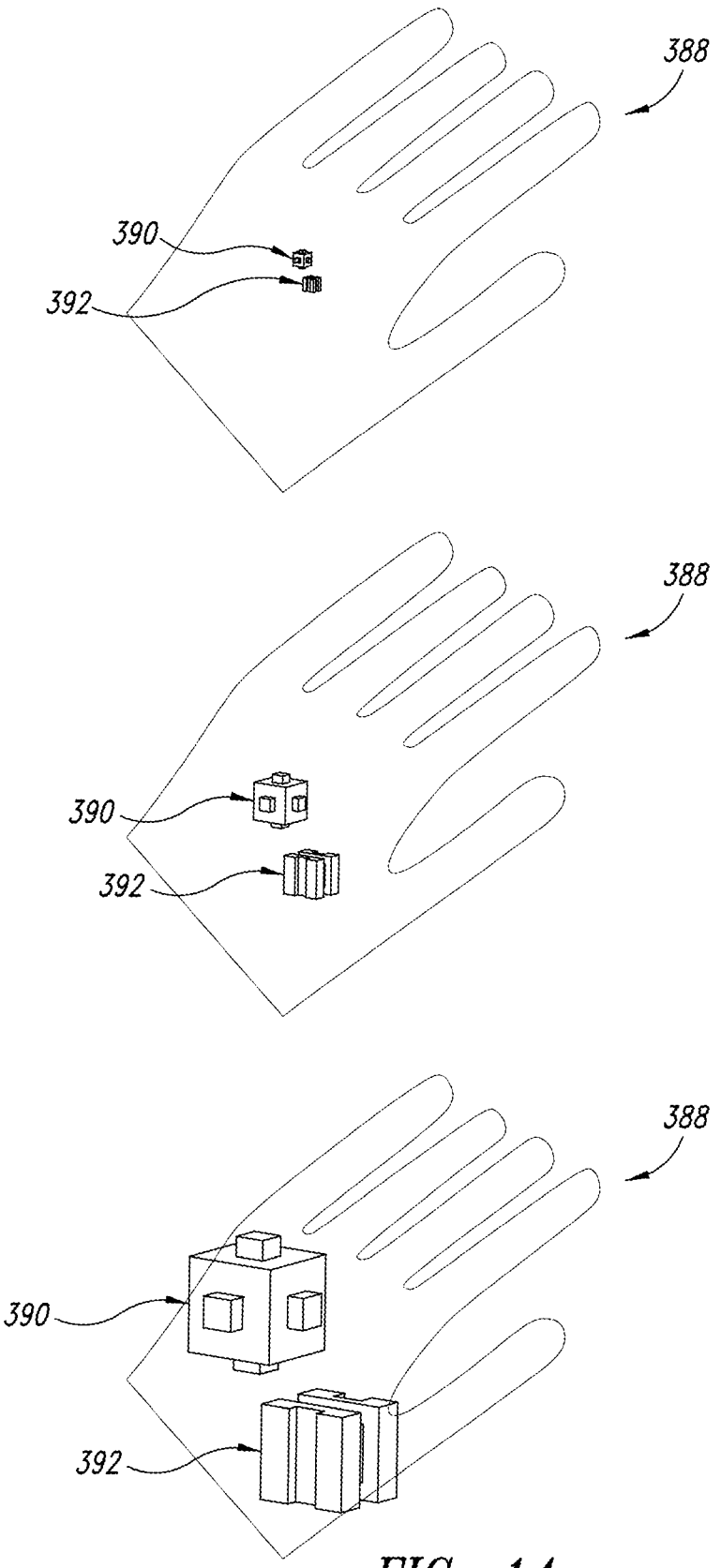
FIG. 14 illustrates the size independence of the basic cubic units in variable sizes in accordance with the present disclosure.

The dynamics of the universal snapping modular block system can function at any piece scale manageable by the human hand 388, as shown in FIG. 14. In other words, the units can come in any size that the human hand 388 can manipulate, to build a creation together with other units of the same size. Furthermore, and although the focus of the universal snapping modular block system design is at a piece scale manageable by the human hand, the design also facilitates and enables a piece scale much larger than depicted in the single-channel detail, illustrated in FIG. 14. For example, the piece scale for the male piece 390 and female piece 392 (measured on the female cube edge) for manipulation by the human hand 388 may be any measurement between, for example, 6 mm and 16 mm, but the design of the universal snapping modular block system facilitates and enables expansion to much larger pieces (e.g., 32 mm, 64 mm, 20 cm, 50 cm, 100 cm, etc.).

FIG. 15 illustrates various unique trajectories of insertion between a groove-bearing piece (female) and a node-bearing piece (male). The interlocking block design features two compatible systems incorporating a single male piece and two variant female pieces described as a single-channel female piece and a cross-channel female piece. The male piece and the single-channel and cross-channel female pieces are shown in FIG. 15. The single-channel piece design allows for 18 unique trajectories of insertion between a groove-bearing (female) piece and a node-bearing (male) piece. The cross-channel piece design allows for 30 unique trajectories of insertion between a groove-bearing (female) piece and a node-bearing (male) piece. These methods of locking two pieces together in both systems are shown in FIG. 15 and described below.

The single-channel insertion trajectories as represented in FIG. 15 include:

Top face insertion of single-channel piece via three methods: (1*a*) perpendicular insertion, (2*a*) lateral slide-in, (3*a*) lateral slide-in.

SE face insertion of single-channel piece via three methods: (4*a*) perpendicular insertion, (5*a*) lateral slide-in, (6*a*) lateral slide-in.

SW face insertion of single-channel piece via three methods: (7*a*) perpendicular insertion, (8*a*) lateral slide-in, (9*a*) lateral slide-in.

Bottom face insertion of single-channel piece via three methods: (10*a*) perpendicular insertion, (11*a*) lateral slide-in, (12*a*) lateral slide-in.

NW face insertion of single-channel piece via three methods: (13*a*) perpendicular insertion, (14*a*) lateral slide-in, (18*a*) lateral slide-in.

NE face insertion of single-channel piece via three methods: (16*a*) perpendicular insertion, (17*a*) lateral slide-in, (18*a*) lateral slide-in.

The cross-channel insertion trajectories as represented in FIG. 15 include:

Top face insertion of cross-channel piece via five methods: (1*b*) perpendicular insertion, (2*b*) lateral slide-in, (3*b*) lateral slide-in, (4*b*) lateral slide-in, (5*b*) lateral slide-in.

SE face insertion of cross-channel piece via five methods: (6*b*) perpendicular insertion, (7*b*) lateral slide-in, (8*b*) lateral slide-in, (9*b*) lateral slide-in, (10*b*) lateral slide-in.

SW face insertion of cross-channel piece via five methods: (11*b*) perpendicular insertion, (12*b*) lateral slide-in, (13*b*) lateral slide-in, (14*b*) lateral slide-in, (15*b*) lateral slide-in.

Bottom face insertion of cross-channel piece via five methods: (16*b*) perpendicular insertion, (17*b*) lateral slide-in, (18*b*) lateral slide-in, (19*b*) lateral slide-in, (20*b*) lateral slide-in.

NW face insertion of cross-channel piece via five methods: (21*b*) perpendicular insertion, (22*b*) lateral slide-in, (23*b*) lateral slide-in, (24*b*) lateral slide-in, (25*b*) lateral slide-in.

NE face insertion of cross-channel piece via five methods: (26*b*) perpendicular insertion, (27*b*) lateral slide-in, (28*b*) lateral slide-in, (29*b*) lateral slide-in, (30*b*) lateral slide-in.

The insertion options for the T-channel configuration are similar to the other pieces as described above. Because one of skill in this technology would understand from the foregoing description how to apply the foregoing options to the T-channel configuration, they will not be illustrated or described further herein.

Kits

The system and toy of the present disclosure can be commercialized in the form of a kit containing multiple male and female pieces. These complementary pieces can be sold in assortments of sizes or non-cubic shapes (described below) and with any number of desired pieces.

Figure 16:
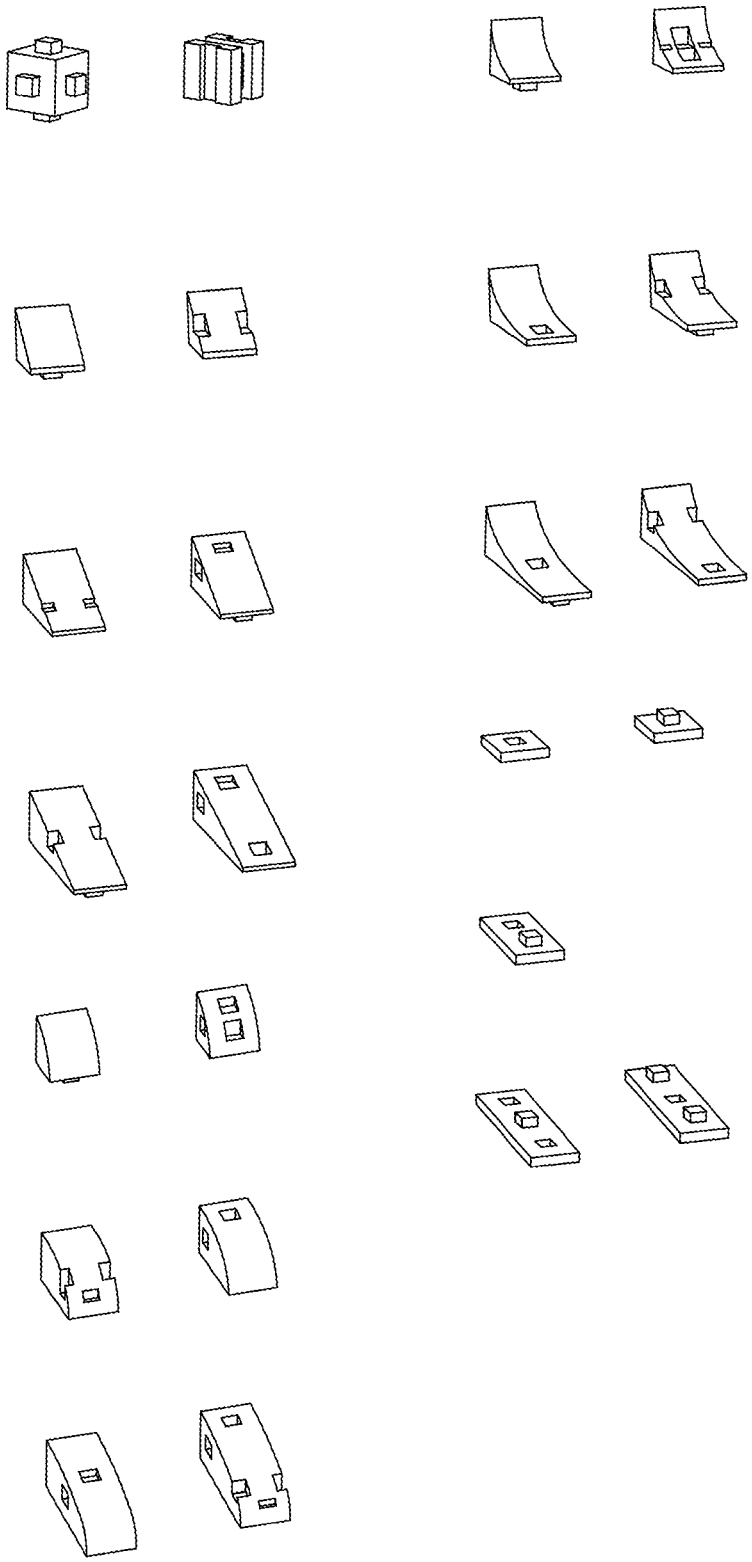
FIG. 16 is a pictorial illustration of various non-cubic pieces formed in accordance with the present disclosure.

Non-Cubic Pieces:

The components of the present disclosure include an unlimited multitude of non-cubic piece designs to enable the design and construction of models at a highly creative and detailed level. Although most of these non-cubic pieces do not snap together in the same universal manner as the core cubic pieces, on a surface to surface connectivity basis they employ the same snapping action (i.e., male nodes, female grooves/channels, and locking moment) as the core cubic pieces. FIG. 16 illustrates representative examples of these non-cubic male and female pieces. There are a multitude of other non-cubic pieces that can be designed and used within the modular block system.

Manufacturing and Material Implementation:

The universal snapping modular block system component of the present disclosure (i.e., the units or pieces) can be manufactured and produced through various processes including stereolithic printing, selective laser sintering, injection-molding, etc. Injection molding is a preferred process of choice as it is the most reliable and accurate production process for achieving the described dynamics of the components. The components are not restricted by material, as various substances enable the components' design, such as nylon. Flexible plastics such as ABS and similarly behaving materials are best. As noted above, the plasticity and malleability of the material (together with the design dimensions of the pieces) can be adjusted to establish the desired resistance, snapping effort and locking action of the pieces.

The various implementations described above can be combined to provide further implementations. Aspects of the present disclosure can be modified, if necessary to employ concepts of the various patents, applications, and publications discussed herein or to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A modular block toy, comprising:

a male cubic unit piece having a geometric shape of a cube with six side faces and a male node extending from each side face of the six side faces, each male node having a same size and shape centered on each side face of the six side faces, each male node having four sides with four corners, and each male node having an exposed face that is sized to be smaller than the face on the male cubic unit piece from which it extends to form a continuous face orthogonal to and extending entirely around the four sides and four corners of the male node; and a female cubic piece having a geometric shape of a cube of the same scale as the male cubic unit piece, the female cubic piece having six side faces, each side face having a female component formed thereon that consists of a cross-shaped channel with a planform shape of a cross that is sized and shaped to receive a respective male node from the male cubic unit piece with only an interference fit thereby enabling the female piece and multiple male cubic unit pieces to be connected together with complete contiguity using any side face of the six side faces of the female piece and to allow multiple female pieces to be attached to any side face of the six side faces of the male cubic unit piece, and to enable manual assembly by the human hand only without the aid of fasteners, tools, and other mechanical devices or means, each cross-shaped channel having a bottom wall that is an exposed portion of the respective side face, and each cross-shaped channel formed of first and second channels that intersect in a center of the cross-shaped channel at a 90-degree angle, each of the first and second channels having a first end and a second end, and each of the first and second channels having first and second pair of opposing side walls extending from the bottom wall, with the first pair of opposing side walls located at the first end of the first and second channels and the second pair of opposing side walls located at the second end of the first and second channels.

2. The modular block toy of claim 1 wherein each male node sized and shaped to snap into the center of the cross-shaped channel through an interference locking engagement.

3. The modular block toy of claim 1 wherein the female piece has a protuberance formed on each corner to extend onto each face adjacent to the respective corner to define the female component as the cross-shaped channel.

4. The modular block toy of claim 1 wherein each male node sized and shaped to snap into the center of the cross-shaped channel through an interference locking engagement, and wherein the female piece has a protuberance formed on each corner on each side face to extend onto each face adjacent to the respective corner to define the cross-shaped channel, each protuberance having an interior corner that includes a radially inward extending ramp with a distal face that engages the male node in the interference locking engagement, the length of the ramp is such that it will extend to and slightly past a respective male node when the male node is not received in the cross-shaped channel to thereby create an interference fit with the male node when the male node is inserted into the cross-shaped channel.

5. The modular block toy of claim 4, wherein the distal face on the interior corner of each protuberance on the female component includes beveled edges on both sides, and each corner on the male node comprises a beveled that is substantially parallel to the respective distal face on the interior corner of each protuberance on the female component in response to the male node being in the interference locking engagement with the center of the cross-shaped channel.

6. The modular block toy of claim 4, wherein the distal face on the interior corner of each protuberance of the female component comprises a convex distal wall, and each corner of the male node has an arcuate, concave shape with a radius of curvature that ideally is concentric with a radius curvature of the convex distal wall in response to the male node being in the interference locking engagement with the center of the cross-shaped channel.

7. The modular block toy of claim 4, wherein the distal face on the interior corner of each protuberance of the female component comprises a concave distal wall, and each corner of the male node has an arcuate, convex shape with a radius of curvature that ideally is concentric with a radius curvature of the concave distal wall in response to the male node being in the interference locking engagement with the center of the cross-shaped channel.

8. The modular block toy of claim 4, wherein the distal face on the interior corner of each protuberance of the female component comprises a centrally disposed right angle indent, and each corner of the male node has a right angle corner that is sized and shaped to engage the respective centrally disposed right angle indent in response to the male node being in the interference locking engagement with the center of the cross-shaped channel.

9. The modular block toy of claim 4, wherein the distal face on the interior corner of each protuberance of the female component comprises a centrally disposed right angle corner, and each corner of the male node has a right angle indent that is sized and shaped to engage the respective right angle corner of the female component in response to the male node being in the interference locking engagement with the center of the cross-shaped channel.

10. The modular block toy of claim 4, wherein the distal face on the interior corner of each protuberance of the female component has a rounded convex shape, and each corner of the male node has a convex shape that is sized and shaped to engage the respective rounded convex shaped coiner of the female component in response to the male node being in the interference locking engagement with the center of the cross-shaped channel.

11. The modular block toy of claim 1 wherein the male cubic unit piece and the female piece are sized to be manipulated by human hands such that the male cubic unit piece can be held in one hand and the female piece held in the other hand and through manipulation of two human hands, the male cubic unit piece and the female can be connected together.

12. The modular toy block of claim 1 wherein the female component has one of a snapping bump, ramp, and groove that creates an interlock between a respective mating male node and the female component when connected together in a flush face-to-face manner.

13. The modular toy block of claim 1 wherein the male node and the female component each have one of a snapping bump, ramp and groove that creates an interlock between the respective mating male node and the female component when connected together in a flush face-to-face manner.

* * * * *